United States Patent [19]

Williams

[11] Patent Number: 4,493,296

[45] Date of Patent: Jan. 15, 1985

[54] THREE CYCLE ENGINE WITH VARYING COMBUSTION CHAMBER VOLUME

[76] Inventor: Gerald J. Williams, R.R. #2, Nolalu, Ontario, Canada, P0T 2K0

[21] Appl. No.: 268,019

[22] Filed: May 28, 1981

[51] Int. Cl.[3] ..... F02B 75/22

[52] U.S. Cl. ..... 123/55 AA; 123/56 C; 123/188 A

[58] Field of Search ..... 123/55 R, 55 A, 55 AA, 123/56 R, 56 C, 58 R, 58 A, 58 AA, 58 AM, 58 AB, 70 R, 48 A, 48 AA, 78 R, 78 E, 78 F

[56] References Cited

U.S. PATENT DOCUMENTS

| | | | |
|---|---|---|---|
| 947,226 | 1/1910 | Dorffel | 123/55 AA |
| 1,319,756 | 10/1919 | Chorlton | 123/55 A |
| 1,443,885 | 1/1923 | Owen | 123/78 F |
| 1,774,087 | 8/1930 | Dunn | 123/55 AA |
| 2,120,012 | 6/1938 | Anoreau | 123/48 AA |
| 3,274,982 | 9/1966 | Noguchi et al. | 123/55 AA |
| 3,623,463 | 11/1971 | Uries | 123/70 R |

FOREIGN PATENT DOCUMENTS

| | | | |
|---|---|---|---|
| 0434838 | 2/1912 | France | 123/188 A |

*Primary Examiner*—Craig R. Feinberg

[57] ABSTRACT

A piston type internal combustion engine of novel three cycle variety, in which the intake and compression functions are divorced from the combustion cylinder entirely and are carried out by a separate high pressure compressor; with a high pressure charging cycle, a power cycle and an exhaust cycle carried out in the combustion chamber in a positive manner. The gas charge is pre-compressed to maximum permissible value and injected into a varying volume combustion chamber, without any appreciable change in pressure. Power output is varied by varying the initial volume of the combustion chamber. Executed in radial cam driven and crank driven versions. Intended to replace conventional variable output engines.

3 Claims, 26 Drawing Figures

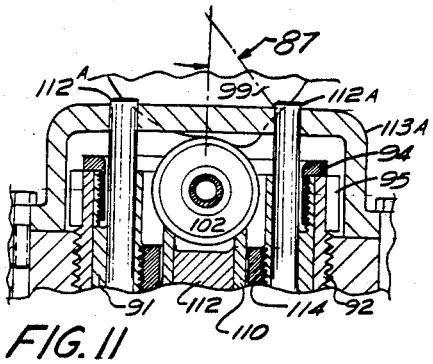
FIG. 11
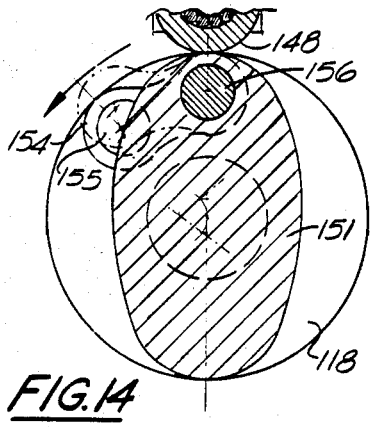
FIG. 14
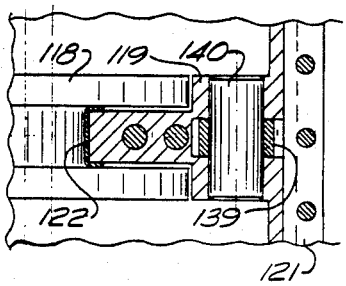
FIG. 15
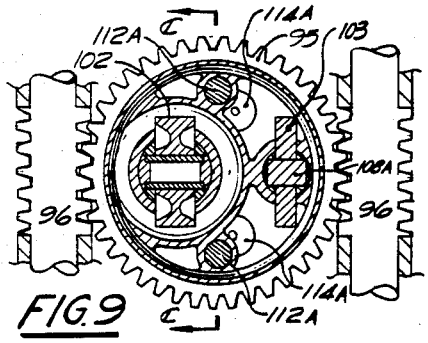
FIG. 9
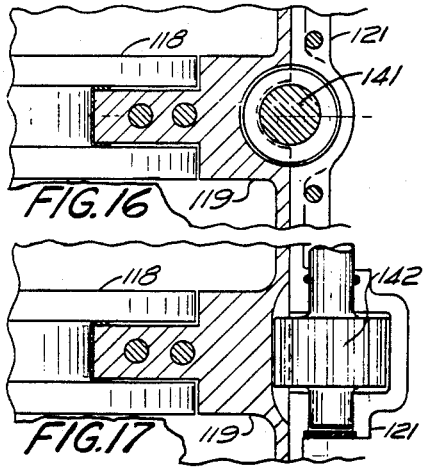
FIG. 16
FIG. 17
FIG. 18
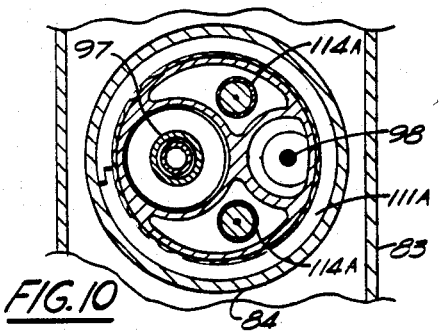
FIG. 10

THREE CYCLE ENGINE WITH VARYING COMBUSTION CHAMBER VOLUME

FIELD OF THE INVENTION

This invention relates to piston type internal combustion engines; more particularly to a novel three cycle engine in which the power output is varied by varying the initial volume of the combustion chamber, with the charge pre-compressed to constant maximum permissible value.

BACKGROUND OF THE INVENTION

Positive displacement internal combustion engines may be divided into many categories, two of which could be: fixed output and variable output engines. Especially for private vehicles, variable output engines are used in large numbers. This invention relates to variable output engines.

Power output is normally varied by varying the amount of charge combusted during each combustion cycle and by spacing the combustion cycles closer or farther apart time wise. For efficiency each of the varying amounts of charge combusted during each combustion cycle should be combusted under the following conditions:

1. Oxidizer to Oxidant Proportioning and Dispersion, air to fuel ratio. This should be right, so that all fuel molecules are completely oxidized, yet not too much air must be present, since too much air simply represents useless mass moved around a lot and expelled at higher temperatures than taken in thus carrying energy with it. Also excess air takes up space and this increases the combustion chamber volume decreasing the effectiveness of the conversion process; so do contamination products such as exhaust gas remnants. Contamination products block effective oxidization. Gasoline engines normally do have proper proportioning, either carburettored or fuel injected into the airstream. Diesels normally have poor proportioning under reduced output, since normally the amount of air entering is not throttled or regulated, because a full volume of air is required for raising the compression temperature sufficiently for ignition of the directly injected fuel.

2. The pure, properly proportioned and properly dispersed charge should be contained in a minimum relative volume of space upon ignition. Diesels score favourably here, but could be improved by proportionally reducing the amount of air and the volume of the chambers as the amount of fuel injected is reduced to vary power output. Normal gasoline engines score poorly in this respect. The weight of the properly proportioned and dispersed gas charge is varied to vary power output, but this varying weight is ignited in a fixed volume chamber, so that only at wide open throttle the actual compression pressure reaches permissible and efficient limits. Great improvement could be made by reducing the volume of the chamber in proportion to the weight of the gas charge admitted so that at all times, during varying power output, the charge is at maximum permissible pressure upon ignition.

3. The properly proportioned varying charge weight, as per item 1, compressed to maximum permissible values in each cycle, as per item 2, now must be expanded to near atmospheric pressures. This requires a varying length of stroke, as the charge weight is varied. Starting with a stroke length that is sufficient to fully expand the charge at full power output, the stroke length should be reduced as the weight of the gas charge becomes less when reducing power output, so that expansion below atmospheric pressure is avoided. Crank driven normal engines may have full expansion at a certain reduced power output, possibly at 25% of full power. Brayton cycle and axial and radial cam driven engines may have nearly full expansion at an output range which is near maximum, but there is the possibility that expansion to below atmospheric pressure occurs during low power output periods. Crank driven engines may be built which limit the charge by delayed opening or closing the intake valve, the limited charge may then be compressed to maximum permissible value in a chamber designed to accommodate this limited charge and the limited charge may thus be chosen to be such that it fully expands during the power stroke, but these remedies apply then only at full power output, and expansion to below atmospheric pressure becomes a possibility for low output periods. Ideally then, automatic means should be provided to avoid expansion below atmospheric pressure in the very low output range, if a large expansion ratio design is chosen, resulting in a constant geometric and gas expansion ratio but in a varying geometric volume for initial and final combustion chamber volumes. 4. Heat losses to the cylinder head, piston crown and cylinder walls should be avoided; with insulated cylinder heads and piston crowns probably being the most practical object. 5. Waste motion, especially of the heavy parts designed for combustion forces, such as pistons, rods, cranks, etc. should be minimized. Functions which can effectively be carried out by lighter auxiliary parts, such as exhausting, intaking and compressing, in other words, recycling functions, should be divorced from the heavy duty components where possible. In conventional 4 cycle engines, the pistons, con-rods and cranks are used for re-cycling functions, while in conventional 2 cycle engines the re-cycling is not carried out positively so that contamination of the charge, or adequacy of the charge, becomes a real problem. Ideally, therefore, any light duty re-cycling functions, which can be divorced from the heavy duty power train components without danger of contaminating or wasting the charge, should be divorced.

6. Friction losses are typically 8% of the generated mechanical power and are directly subtracted from it; they should be minimized. Carrying out light duty recycling functions such as intaking and compressing the fresh charge with fewer larger components which have less friction area and travel, improves the efficiency. Conventional engines using the power train components such as pistons, con-rods, cranks, for these purposes, generate considerable friction area and component travel; in excess what can be accomplished by fewer larger components.

SUMMARY OF THE INVENTION

The present invention provides engines in which the gas charge is pre-compressed to maximum permissible values under all, or most, of the power output range. This is achieved by divorcing the intake and compression functions from the power cylinders and carrying out these functions in a separate, high pressure pre-compressor. Power output is varied by varying the initial volume of the combustion chamber, during the high pressure charging cycle, thereby regulating the amount of charge admitted into the combustion chamber, resulting in a varying geometric expansion ratio. The power cylinder carries out three functions, receiving the pre-compressed high pressure charge, with the piston in or near the top position; immediately combusting and expanding said charge during the downstroke of the piston and expelling the remnants of the combusted charge during the upstroke, resulting in three distinct cycles, within the power cylinder. The engine is executed in radial cam driven and crank driven versions. The novel three cycle engine has additional advantages 1. A very advantageous weight and friction trade off. For the extra weight of compressor cylinders, compressor pistons and drive rollers, compressor valve gear and high pressure charge distribution ducts, the effective power output of the engine is doubled, as compared with a four cycle version, without increasing the weight of the basic engine, since the piston delivers power during every downstroke. The few, large compressor components have far less, about 66% less, friction surface than the engine components normally used in four cycle engines, for the intake and compression function. No extra radial cam is required for the high pressure pre-compressor, for the radial cam driven version.

2. It makes it simple to ensure that the charge is at maximum permissible pressure values during the complete power output range; the only sensor required is a charge pressure sensor. The high pressure pre-compressor would use technology already well developed for air compressors namely, a pressure sensor, and an unloader acting on the pre-compressor self-acting intake valves. In another invention by this inventor, entitled "A varying geometric compression ratio engine", a common four cycle engine is provided with a continuously re-adjusting geometric compression ratio to at all times, during varying power output, compress the charge weight to maximum permissible absolute pressure values, regardless of charge weight taken in; this requires many sensors to measure the exact weight of charge mass taken in during each cycle; and complex controls and power actuators are required to accurately, instantly and continuously vary the geometric compression ratio. This invention takes the opposite path; throttling is not used but instead power is varied by varying the initial volume of the combustion chamber. In other words, the volume of the combustion chamber during the charging cycle determines the weight of the charge mass admitted, with the charge pressure being at constant maximum value. No sensors of any kind are required to obtain consistent results, except, of course, the pre-compressor pressure sensor. In other words, the pressure values of the gas charge in this invention are constantly, directly monitored and feed back is constant. In the other invention by the inventor mentioned above, the pressure values to be obtained are not directly monitored, unless a pressure sensor is installed in the cylinder. This refers strictly to constant pressure values for the charge; it does not apply to correct proportioning of the charge. Electronic fuel injection is preferred with this invention and preferably with injection carried out after the pre-compression of the air charge; this would cool the pre-compressed charge at the right location resulting in a denser charge, yet would not reduce the pressure of the charge since the pressure sensor would increase compressor output to maintain the maximum pre-set value. The energy absorbed by the vaporizing injected fuel will be the same no matter where it is injected, thus injecting fuel after pre-compression is not determined to efficiency.

Further aspects of the preferred embodiment of the invention, the radial cam driven version, are positive total exhaust expulsion, retention of the piston in the top position while high pressure charging is carried out, novel, annular, concentric sleeve valves, ensuring efficient charging, a novel reciprocating, charge biased, combustion chamber roof, quick acting valve camshafts and valve actuators, novel deep penetration power camshaft, novel piston to cam connecting means and a low profile or narrow width. Conventional type valving is also disclosed for this version.

The alternative embodiment of this invention, the crankshaft driven version, uses the novel cylinder head of the preferred embodiment, or may use conventional type valving with both alternatives disclosed.

The objects of the invention may be summarized as follows:

1. To provide an engine of variable power output, maintaining efficiency over all or most of the power output range, despite variations in the gas charge mass combusted, using a variable geometric combustion chamber volume.

2. To provide a diesel engine of variable power output in which it is not necessary to take in more air than required for combustion, using a variable geometric combustion chamber volume.

3. To provide an engine in which contamination of the fresh gas charge by exhaust gas remnants, may be reduced to negligible value if desired.

4. To provide an engine which delivers power during every downstroke of the piston without the unpositive recycling procedure of the conventional two strokes cycle. To produce positive charging, positive exhaust expulsion.

5. To provide an engine in which the swept piston volume is sufficient to expand the admitted gas charge to near atmospheric pressure levels, under high power output operation. It is known that the exhaust gasses. normally are expelled with considerable pressure remaining under near full power operation. Limiting the charge admitted in conventional engines by manipulating with intake valve timing results in excessive wasted motion in these engines. Conventional, four cycle engines already have 80% waste motion, required for recycling, with the actual power stroke amounting to only approximatley 20% of the motion; thus manipulating the intake valve timing to reduce the charge admitted so that full expansion may occur near the full output range, results in even more wasted motion for conventional engines. In the present invention, the size of the pre-compressor piston may be chosen so that, in the upper output range, nearly full expansion takes place. This fact, plus the fact of efficient combustion for each downstroke, makes the present invention advantageous. Briefly stated, the invention therefore, may achieve less wasted motion, nearly full expansion at the most used engine speed for a particular application, and a greater gas expansion ratio at all speeds, and maintain good combustion efficiency at all speeds. Efficient combustion is the result of contamination free charging, and the greater or maximum possible gas expansion ratio is the result of the compression of the charge to maximum permissible levels for the particular fuel used, under all, or nearly all, power outputs. Nearly full expansion at the most used engine speed is the result of sizing the gas charge pre-compressor so that at the most used engine speed the capacity of the pre-compressor is nearly utilized. This ability to select the capacity of the pre-compressor independently of the size of the engine results in the said less wasted motion, at the most used engine speed.

These and other features and advantages of the invention will be more fully understood from the following description of certain preferred embodiments taken together with the accompanying drawings.

BRIEF DESCRIPTION OF THE DRAWINGS

In the drawings:

FIG. 9 is a sectional view taken on Plane A—A in FIG. 8.

FIG. 10 is a sectional view taken on Plane B—B in FIGS. 6 and 8.

FIG. 11 is a sectional view taken on Plane C—C in FIG. 9.

FIG. 14 is a sectional view taken on Plane D—D in FIG. 13.

FIG. 15 is a sectional view taken on Plane E—E in FIG. 12.

FIG. 16 is an alternative of the embodiment shown in FIG. 15.

FIG. 17 is an alternative of the embodiment shown in FIG. 15.

FIG. 18 is an alternative of the embodiment shown in FIG. 15.

DESCRIPTION OF THE ILLUSTRATED EMBODIMENTS

Figure 1:
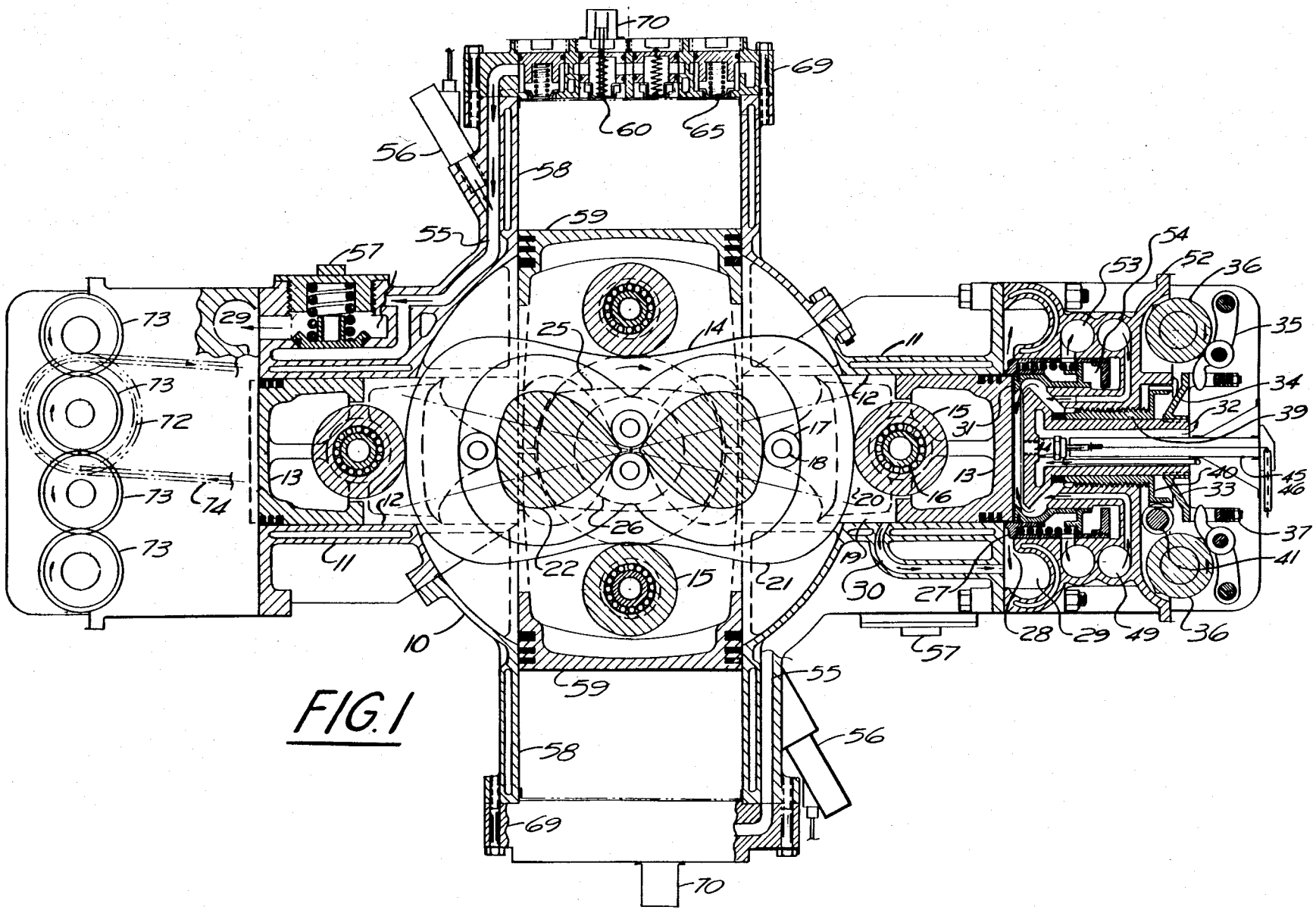
FIG. 1 is a cross sectional view showing the pertinent parts of an internal combustion engine of novel radial cam driven three cycle variety formed according to a preferred embodiment of the invention, with an optional but not preferred, bottom location for a charge pre-compressor cylinder shown. An in-line top position for the compressor cylinders is preferred and is shown in FIG. 3.

Referring to FIG. 1 of the drawings, there is shown an internal combustion engine generally indicated by numeral 10. Engine 10 includes two opposed cylinder blocks, 11, each defining two power cylinders 12 in a row, to arrive at a flat four opposed cylinder layout. The perfectly symmetrical layout of the power train shown, gives perfect dynamic balance for the power train. Each power cylinder 12 is provided with a reciprocatably disposed power piston 13 of special configuration. The power shaft is a deep penetration, double lobed power camshaft 14, is connected to power pistons 13 by means of a main cam roller 15, rotatably carried on a main cam roller pin 16, a cam follower roller 17, rotatably carried on a cam follower roller pin 18 and slotted piston skirts 19, which are cross connected by piston webs 20. Piston webs 20 bear against flat machined front and back faces of the radial power camshaft 14, thus straddling the profile on the radial cams 21, effectively trapping the power pistons and preventing them from rotation in their bores. This feature is very important, since any rotation of the power pistons would make the rollers 15 and 17 go askew and jam the engine. Slotted piston skirts 19 and piston webs 20 bearing against flat machined faces on the radial cams 21, to prevent rotation of power pistons 13 are a novel feature of this invention. The power cylinders 12 are radially slotted to clear and straddle the flat faces of the radial cams 21. The piston rings do not traverse these slots to avoid oil consumption. The double lobes on the radial cams 21 are symmetrical and provide four piston strokes per revolution. The profile of the radial cams 21 are executed to accelerate and decelerate the pistons uniformly, an advantage while the stroke is slightly less than the bore of the power cylinders. The profile furthermore is executed to retain the power pistons stationary in the top position over 28 degrees of power cam shaft rotation, ensuring adequate time for high pressure charging during the charging cycle. This has the additional benefit that the piston of the high pressure precompressor in the second row will be retained stationary in the top position over an identical degree of rotation ensuring that all space containing the high pressure charge is utilized during the charging cycle of the power cylinders. This feature will be elaborated upon later. To return to the novel features of the power cam shaft 14; to reduce the profile, or height or width, of the engine, cam follower rollers 17 penetrate deeply into the heart of power camshaft 14, a novel feature. The unswept area on the outward faces of the radial cams 21 are utilized as cross connecting bridges 22 connecting the radial cams 21 outwardly to the outward bearing journals 24, by way of outward transition pieces 23, shown in FIG. 2 and FIG. 3. Power pistons 13 are executed to clear these cross connecting bridges 22; the bifurcated bottom end of the power piston 13 includes an extra long outward leg, shown in dotted outline, which carries the cam follower roller 17 on an inwardly cantilevered cam follower pin 18; it is this extra long outward leg which is executed to clear the cross connecting bridges 22. Since in this novel three cycle engine, a downward pressure bias is always experienced by the power pistons 13, the cam follower roller 17 forms a minor function and therefore, is reduced in size. The uniform deceleration experienced by the piston during its final upward travel further reduces peak stressing of cam follower roller 17.

Radial cams 21 essentially consist of a flat web with an outward facing flange around the perimeter. By placing two of these radial cams 21 back to back, with the cross connecting bridges 22, outwardly, room is provided in the center of the engine for a large center main bearing journal 26. To provide a smooth transition of stress from the cross connecting bridges 22 to the center main bearing journal 26, inward transition pieces 25 are provided. The inward legs of the bifurcated bottom end of the power pistons 13 is executed to clear the inward transition pieces 25. Outward transition pieces 23 and inward transition pieces 25 have approximately the same depth as the thickness of the cross connecting bridges 22.

Turning now to the novel cylinder head, a cylindrical sleeve, U-shaped in cross section forms the exhaust sleeve valve 27. The sealing face of this valve bears annularly on the top edge of the power cylinders 12 with a full annular, slotted, exhaust port 28 leading to exhaust torus 29. The engine is executed to provide extremely efficient and total exhaust expulsion. At the bottom of the stroke, a number of bottom exhaust ports 30, may take advantage of the downward directed kinetic energy of the combusted gas charge to allow the bulk of the exhaust to escape laterally in all directions. These optional bottom exhaust ports are shallow in height but are disposed 360 degrees, not shown as such, around the cylinder wall; the shallow height does not rob any significant amount of power, while the 360 degree deployment still offers a large escape area. During the upstroke of the power piston 13 exhaust sleeve valve 27 is opened and the remnants of the exhaust are thus expelled with a minimum in back pressure.

During the upstroke of the power piston 13, the admission sleeve valve 31 is lowered to a position, which just clears the top position of the power piston 13. Telescoping head 32 is strongly biased downwardly by the high pressure of the pre-compressed charge due to area differential, and carries admission sleeve valve with it till stopper disc 33 bottoms out on travel limiter 34. Stopper disc 33 is threaded onto the hollow stem of telescoping head 32 and may be precision adjusted to stop the travel of telescoping head 32 to clear the top position of the power piston 13 by a close margin. There are two reasons for this action. The admission valve takes advantage of the upward exhaust stroke to be ready and in position for the high pressure charging cycle. The down position of the complete combustion chamber roof formed by admission sleeve valve 31 and telescoping head 32, makes exhaust expulsion total and positive, especially with the full circumference of the top edge of the power cylinder open. After the power piston 13 has reached the top position of its travel, exhaust sleeve valve 27 closes fully; exhaust sleeve valve 27 started closing well ahead of the power piston reaching its top position. The thin layer of exhaust gas squished above the top of power piston 13 during the last few degrees of piston travels serves to cushion the piston travel to some extent. Bias breaker arms 35 are now actuated by a quick acting lobe on the valve camshafts and make contact with bias breaker towers 37, which are integral ports of stopper disc 33. The result is that telescoping head 32, is lifted slightly off admission sleeve valve 31, which is held down rigidly by intake push rods 38, shown in FIG. 4. The high pressure charge will rush in below telescoping head 32, and will now bias same in the reverse upward direction, again due to vast area differential.

The amount of upward travel of telescoping head 32 by gas pressure is pre-determined by the position of jack screw 39, which position controls the power output of the engine. Jackscrew 39 comprises a hollow cylinder, externally threaded to match a mating thread in the cylinder head casting, and is provided with a worm gear, jackscrew drive gear 40 at the top. Jackscrew drive gear 40 is engaged by worm shaft 41 which is power actuated in a linear relationship with the throttle pedal position in the vehicle; if the engine is used in a vehicle. The position of jackscrew 39 therefore, determines the volume of the combustion chamber, and which volume in turn determines the quantity for the weight of the charge admitted, with the charge being at a constant maximum permissible pressure, and, as stated, the weight of the charge for each charging cycle determines the energy of the power stroke.

Figure 4:
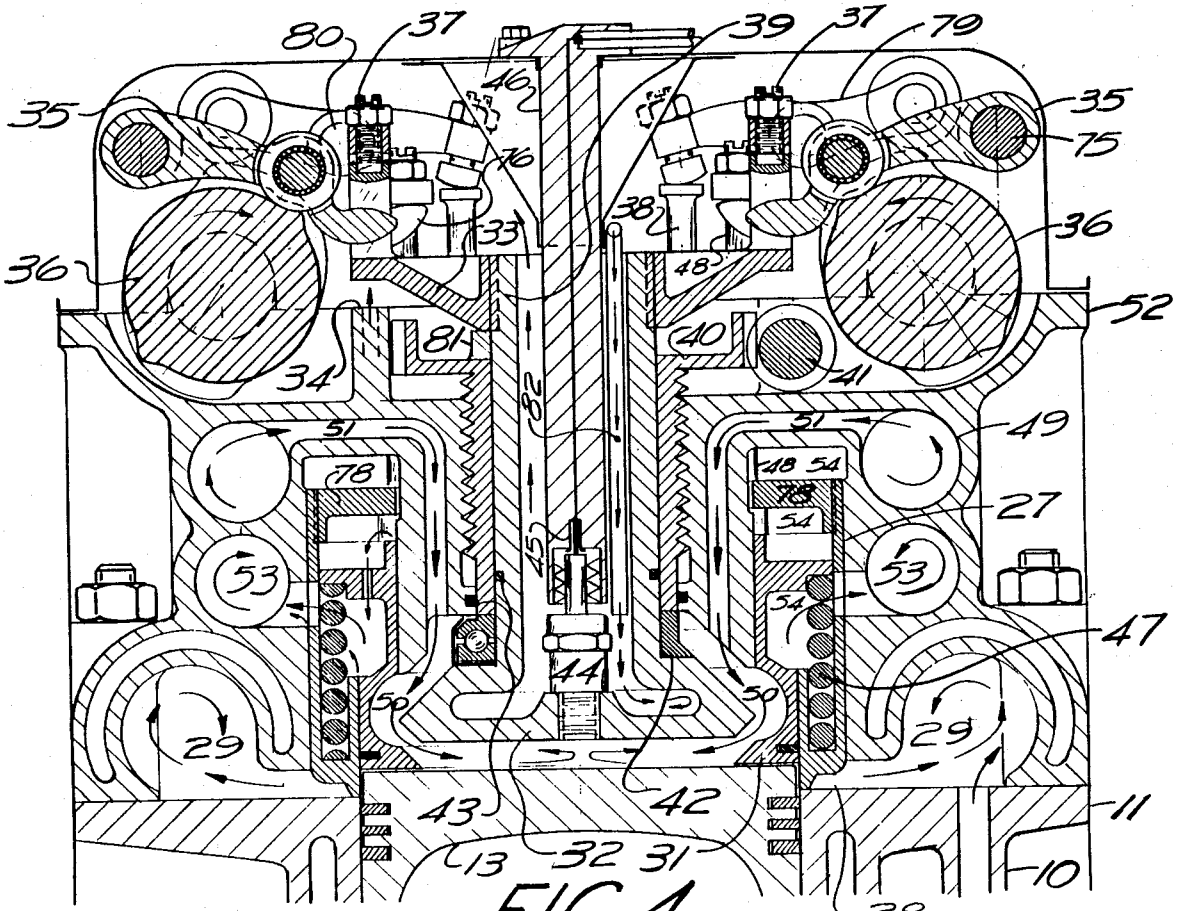
FIG. 4 is an enlarged cross section of the cylinder heads shown in FIG. 1 showing the novel valve train and gas ducting.

Telescoping head 32 is provided with hardened steel impact ring 42, which may be replaced by an anti-friction bearing as shown in FIG. 4. The threads on jackscrew 39, are well lubricated by engine oil, with seals 43, shown in FIG. 4 preventing loss of high pressure charge.

Power camshaft 14 is executed to retain power piston 13, in the top position over 28 degrees, as clearly shown in FIG. 1, and by the end of this retention, intake sleeve valve 31 is closed by valve camshaft 36. A powerful charge bias, due to area differential aids in lifting admission sleeve valves quickly to the closed position. At this instance, spark plug 44 ignites the charge. Spark plug 44 is electrically connected through a sliding sealed joint 45, within an insulated rod 46, with the ignition coil, not shown. Exhaust sleeve valve 27, and admission sleeve valve 31 are biased in opposite directions by a commonly shared, large concentric coil spring, mutual valve spring 47. The travel and positions of exhaust sleeve valve 27 have fixed limits. The travel and positions of admission sleeve valve 31 do not have a fixed top position - the bottom position has a fixed limit. Therefore, the lash between the valve camshaft 36 and admission push rods 38, can be fairly large, but, as stated before, this causes no problem since admission sleeve valve 31 is carried downward by the downward bias of telescoping head 32 as soon as the downward bias overcomes the upward bias of the combusting gas charge, near the final portion of the power stroke, and the admission lobe on valve camshaft 36 is executed to take up this lash gently and has plenty of time to do so, namely, the complete exhaust stroke.

Figures 2, 2A:
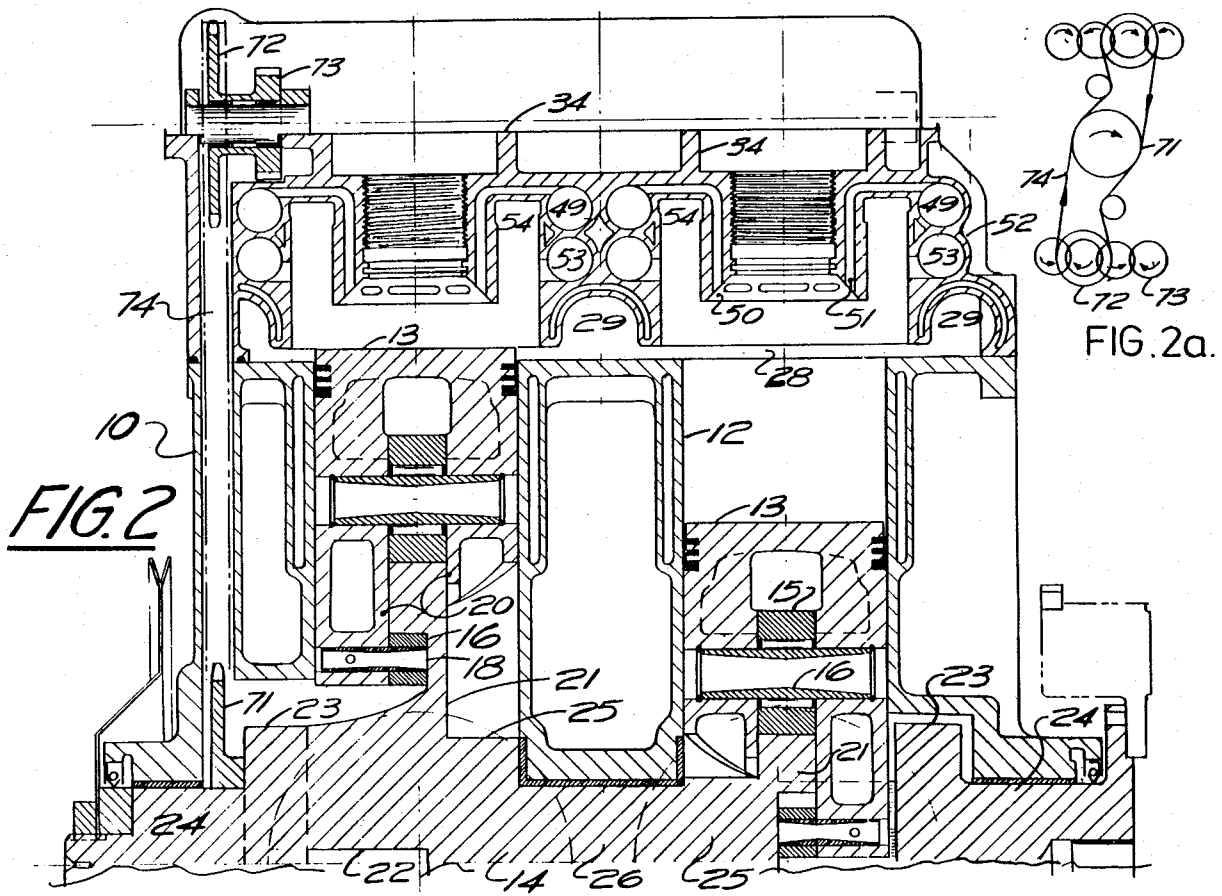
FIG. 2 is a longitudinal cross section showing one half of the engine shown in FIG. 1 on a plane taken through the power cylinders and with the valve train omitted to clearly show the features of the casting of the cylinder head.
FIG. 2*a* shows the valve train.

Exhaust sleeve valve 27 is lifted by exhaust pull rods 48, shown in FIG. 4. "Tappet" clearance is adjusted by conventional threaded means, as shown in FIG. 4; with the admission sleeve valve tappets adjusted for full power output, maximum combustion chamber volume. Since power pistons 13 carry out two power strokes per revolution, the valve camshafts must be provided with two lobes per engine revolution for each function, the functions being bias breaker, admission sleeve valve depression, exhaust sleeve valve lifting. Since quick action is required over few degrees of rotation for the novel three cycle action, the valve camshaft minor diameter is substantial and roller equipped rockers aid in this respect. FIGS. 1 and 4 show valve camshafts running at the same speed as the engine and equipped with two lobes per revolution. FIG. 2 shows a chain drive for said valve camshafts with a speed increase of two. This is optional and has the advantage of doubling the available degrees for each lobe, and reduces the number of lobes to one instead of two for each function, and is therefore, the preferred embodiment. Optionally, the valves may be operated by push rods and rockerarms directly from radial valve cams installed directly on the radial power cam shaft.

Counter rotating the valve camshafts makes all components of the valve train identical, except for the valve camshafts themselves, which are LH and RH. Making the front and back ends of the valve camshafts identical may result in identical interchangeable valve camshafts.

The high pressure pre-compressed charge is delivered to the cylinder head via torus-shaped intake torus 49, which communicates with the annular intake port 50 via a number of admission ducts 51, in the cylinder head casting 52, arranged all around jackscrew 39. Leakage paths for the high pressure pre-compressed charge in the valve area are intercepted by suction torus 53, which communicates with annular valve space 54, via communication openings in the cylinder head casting and holes in the sleeve wall of exhaust sleeve valve 27, as clearly shown on the drawings.

Figure 3:
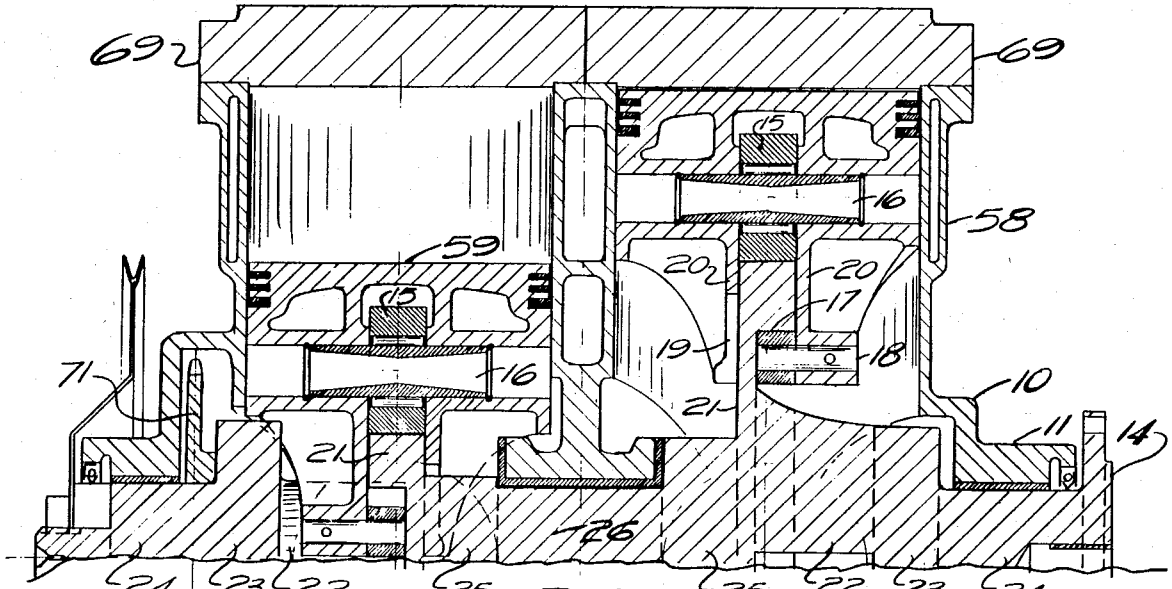
FIG. 3 is a longitudinal cross section, taken through the center plane of the charge pre-compressors, of the engine shown in FIG. 1.

Suction torus 53 is connected with the intake duct for the high pressure charge pre-compressor, while the precompressed charge is delivered to admission torus 49 via integrally cast pre-compressor outlet ducts 55. Fuel may preferably be injected into outlet ducts 55, as shown by the location of electronically controlled fuel injectors 56. Any premature explosion of the high pressure charge is relieved by way of a number of backfire relief valves 57, leading to exhaust torus 29. It should be noted that the preferred embodiment uses two pre-compressor cylinders 58 in line, as shown in FIG. 3, with the back pre-compressor feeding the front opposed power cylinders 12. Radial cams 21 are ninety degrees out of phase, giving a firing impulse every ninety degrees with opposed power cylinders firing simultaneously. The ninety degree phasing brings back pre-compressor piston 59 in the top delivery position at the same time that the front power cylinders 12 are ready to receive a charge; the volume of the pre-compressor clearance space, which is the volume of space above pre-compressor piston 59, together with the volume of ducts 55, torus 49, ducts 51, port 50, is considerable in relation to the volume of the charge delivered, and acts as a receiver tank. A pressure sensor, not shown, will sense the pressures in this "receiver tank", while simple electronic circuitry may relate peak pressure pulses, engine rpm and the position of telescoping head 32, so that the pre-compressor may unload at pressures which may ensure the delivery of a charge into the combustion chamber which is at near maximum permissible values. The peak pressures in the "receiver tank" will be slightly above the final delivered pressure, but the difference may be reduced by enlarging the volume of the "receiver tank", following well known physical gas laws. For economy versions of the engine, heat losses of the pre-compressed charge to the surroundings need not be avoided, but should be taken into account in selecting the pressure, and the size of the pre-compressor cylinder 58, and also the maximum volume of the charging space in power cylinders 12, as determined by maximum top position of telescopic head 32, may be such that near full expansion of the combusting charge will be accomplished during the most used power output range, in automobiles, possibly 75% full power. This invention therefore, can accommodate one of the objects of the invention, namely, maximized expansion in the most used power output range, without excessive wasted motion in this most used power output range.

On the other hand, for special applications such as racing versions, the pre-compressor size and charging space volume may be such that a supercharger effect takes place; in this case, the pre-compressed charge may be cooled and the pressure increased as desired to increase the density and increase the power output, by virtue of the fact that a greater charge mass is packed into the combustion chamber than would be obtainable normally in a four cycle version, with the displacement of the power pistons. Diesel versions of this invention would have the advantage of not requiring the intake of more air than required for efficient combustion. At reduced power outputs the mass of the air charge delivered would be proportional to fuel delivery, while the pressure and temperature would remain at a sufficient level, 500 psig approximately, to ignite the injected diesel fuel. Therefore, this invention accommodates more efficient, variable output diesels also; normally these diesels do not throttle their air intake since under all conditions, 500 psig compression pressures approximately must be reached to ignite the diesel fuel injected and therefore, far more air than necessary for efficient combustion is taken in, under reduced power output conditions.

To return to the drawings, pre-compressor cylinders 58, may be arranged in opposed configuration as shown in FIG. 1, resulting in perfect dynamic balance, but this arrangement has two disadvantages:

It will require a larger "receiver tank" to maintain the optimum pressure levels of the charge, approximately 150 to 200 psig, depending on the fuel used since compressor pistons and power pistons are not in the proper relative position, and it makes for an awkward engine layout, with less space for the lube oil sump. Therefore, the preferred embodiment uses two pre-compressor cylinders 58 in-line, with the front one serving the rear power cylinders and vice versa. The upward acceleration of one pre-compressor piston will be cancelled by the downward acceleration of the second pre-compressor piston, etc.; secondary imbalances do not occur since no balance weights are carried by the power camshaft. Since the pre-compressor pistons 59 are in line, a rocking couple will be set up about the center of mass of the engine, and this will be taken care of by mounting the engine on vibration isolating mounts. The intake ducting would include an air cleaner and is not shown. Pre-compressor valves are self actuating, spring biased, free disc type. Intake valve 60, comprises a cartridge for ease of servicing and consists of four parts, a body, disk fingers, which guide and stop the disc, a hat shaped disk, and a bias spring. The end of body is an enlarged, threaded portion, with a wrenching means. The hat-shape of the disk 63 reduces the clearance volume above pre-compressor piston 59, increases the available length for bias spring, and stiffens the disc. Outlet valve 65, similarly consists of three parts, the body, with integral guide fingers, the disc and bias spring. Again, the disk is hat-shaped for similar reasons as given for disc of the intake valve. Eight inlet valves and four outlet valves, as shown in the plan view of the pre-compressor head, would provide ease of aspiration. Unloader apparatus 70, "commercial part", will depress a number of intake valves during the bottom portion of the upward stroke of pre-compressor piston 59 to reduce the pre-compressor output in relationship with power demand and keep the outlet pressure constant. Pulsations and pressure peaks may be dampened out by increasing the volume of the "receiver tank".

Turning now to FIG. 2, the relationship of the various elements, 21, 22, 23, 24, 25, 26—21 - radial cams; 22 - cross connecting bridges; 23 - outward transition pieces; 24 - outward bearing journals; 25 - inward transition piece and 26 - center main bearing journal; making up one piece power camshaft 14 is clearly shown.

The cross connecting bridges 22, make deep penetration of cam follower rollers 17, into the heart of the power camshaft 14 possible. Valve camshaft drive sprocket 71 is shown twice as large in diameter as driven sprocket 72 to drive the camshaft at twice the engine speed, for reasons previously explained. Four valve camshaft driven gears 73 ensure counter-rotation and keep the profile of the engine down. Valve camshaft chain 74 is continuous and serves both cylinder blocks as shown in the small diagram. Two chain tensioner sprockets or rollers serve the dual function of ensuring enough wrap of chain around drive sprocket 71 as well as take up chain slack. Chain 74 may be replaced by one or two timing belts. The moveable components of the valve train are not shown in FIG. 2, so that the configuration of the cylinder head casting may stand out clearly. Particular note should be made of the simplicity of the machining operations required for the cylinder head casting 52. A plane cut across the bottom and top surfaces, an annular cut for the annular valve space 54, and the threading operation for jack screw engaging threads and line boring for the camshaft bearings and jackscrew worm shaft 41 are the only major machining operations required.

FIG. 3 shows the shallow profile of pre-compressor cylinders 58 and pre-compressor head 69, as well as shows the elements of the power camshaft. Also shown clearly are the details of pre-compressor piston 59 which uses rollers 15 and 17 and pins 16 and 18, identical to those used for the power pistons 13. Pre-compressor pistons 59 are trapped on radial cams 21 by a bifurcated bottom end, with webs bearing against the front and back faces of radial cams 21, all as explained for power pistons 13. To install and remove power pistons 13 and pre-compressor pistons 59, the cam follower roller pin 18 must be removed; for the embodiment illustrated this requires "splitting" the engine cases, with the planar joint shown in FIG. 1.

FIG. 4 clearly shows the novel features of the power cylinder heads. Bias breaker arms 35 are mounted on rocker arm shaft 75, which also is the fulcrum for exhaust valve lifter rockers 76. Exhaust valve lifter rods 48 pass through travel limiter 34 and stopper disc 33 to engage exhaust valve lift ring 78 which is threaded into exhaust sleeve valve 27. Admission valve push rocker 79 uses separate fulcrums, rocker shafts 80. Admission push rods 38 also pass through travel limiter 34 and stopper disc 33. As stated previously, valve camshafts 36 may run at engine speed, requiring two lobes per function, or at twice engine speed, requiring one lobe per function.

Also shown is the optional thrust bearing to replace impact ring 42 on telescopic head 32. It should be particularly noted that optional operations of telescopic head 32 are possible. A constantly reciprocating telescopic head 32 has been described, the reciprocating motion being brought about automatically by charge pressure downward biasing and upward biasing, as described previously. This reciprocating motion serves the function of providing positive total exhaust expulsion. If this is not required or desired, a simple ring, anti-telescope ring 81, may be installed between stopper disc 33, and jackscrew 39, as clearly shown in the LH half of the view in FIG. 4. In this case, admission sleeve valve 31 would be carried down and opened at the instant at which exhaust sleeve valve 27 closes, or slightly after. A slightly altered admission valve lobe on valve camshafts 36 would be required. In this case, running the valve camshafts at twice engine speed, which is optioned in any case, would ensure rapid valve action. Admission sleeve valve duration would diminish as the charging chamber volume is reduced. Also, in this case, admission push rods 38 may be made as quick acting, telescoping hydraulic valve actuators, the same in principle as conventional hydraulic valve lifters, since the admission sleeve valve travels downward with telescopic head 32, as this head is adjusted for different engine power outputs, and the lash between admission lobe and admission sleeve valve may be kept at a minimum. Furthermore, in this case, stopper disc 33 and bias breaker arms 35 will be eliminated together with the bias breaker lobe on the valve camshaft.

Cooling of telescoping head is accomplished with engine lube oil injected with oilstand pipe 82. If positive total exhaust expulsion is not required, telescoping head 82 and jackscrew 39 may be integrated as one unit. This would have obvious cost advantage and also would act as a valve rotator, since the contact surface between admission sleeve valve 31 and telescoping head 32 would change due to head rotation. In that case, mutual valve spring 47 should not bear against admission sleeve valve 31, since this valve would rotate with telescoping head 32, but instead should bear against static pins extending downwardly through exhaust valve lifter ring 78. Admission sleeve valve 31 should then also be biased upward by an annular spring acting between the mushroom head bottom portion of telescoping head 32 and the admission sleeve valve, while additional upward closing bias may be obtained from charge pressure biasing by increasing the valve biasing area; in other words, by decreasing the inner sleeve diameter relative to the valve face diameter. The illustrated embodiment of admission sleeve valve 31 has neutral charge pressure biasing in the closed position, but strong charge pressure closing biasing in the open position.

Figure 5:
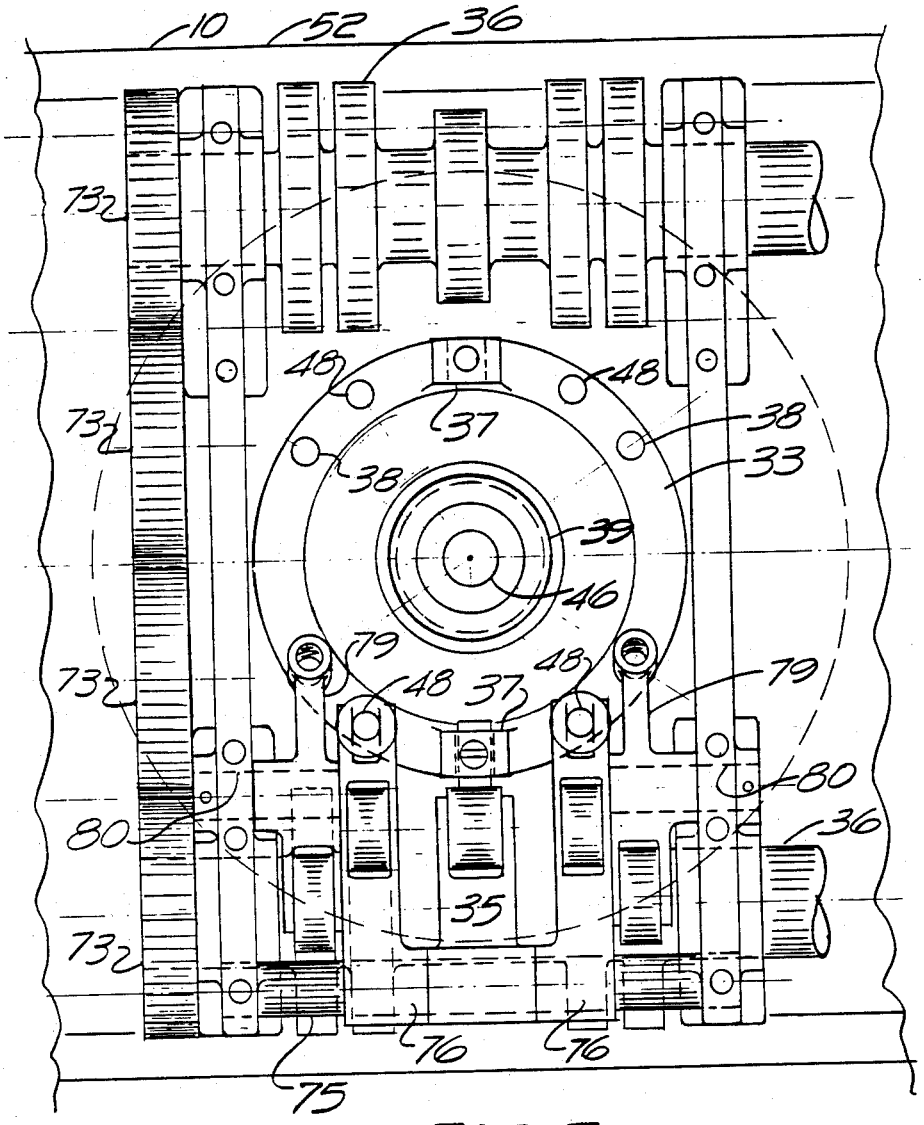
FIG. 5 is an enlarged top view of the novel cylinder head and valve train shown in FIG. 1 and FIG. 4, showing one half of the valve actuating means on one side and one of the two camshafts on the other side.

FIG. 5 illustrates a plan view of the novel cylinder head shown in FIGS. 1 through 4.

Figure 8:
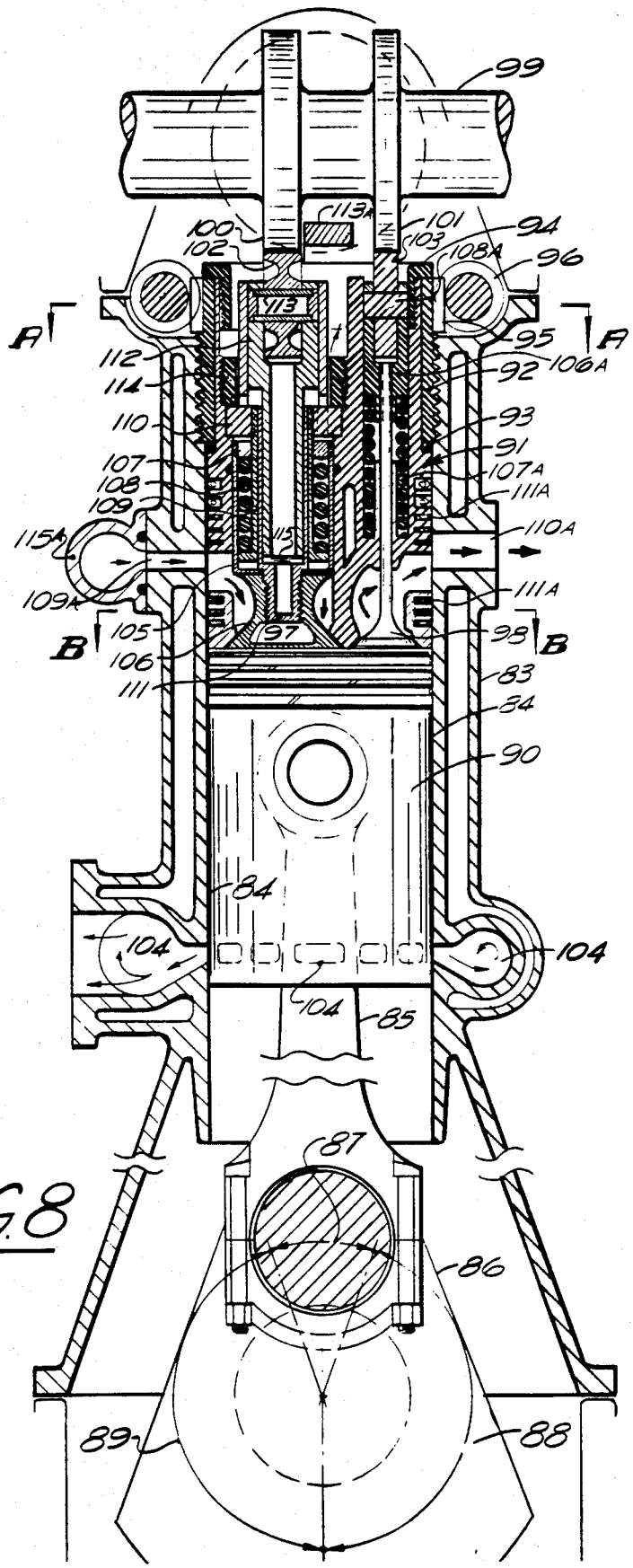
FIG. 8 is a cross sectional view of the engine shown in FIG. 7 using poppet type charge biased intake valving and a poppet type final exhaust valve.

Alternative crankshaft driven versions:

Turning now to the crankshaft driven versions of the invention, in FIG. 8, there is shown a transverse cross section of a cylinder block 83, having one or more cylinders 84, in line. Deep skirted piston 90 is connected with a conventional connecting rod 85 to the power-shaft a long stroking crankshaft 86. Clearly shown at crankshaft 86 are the three cycles of this engine; 87 charging cycle, 88 power cycle and 89 exhaust cycle. The charging cycle commences slightly before the piston 84 reaches top dead center. This gives the intake valve time to open, and with an opening intake valve the slight upward movement of piston 84 will not "compress" the incoming charge significantly or dangerously for three reasons:

a. the charge which has by now entered the "charging" chamber in the cylinder 84, is slightly below pressure
b. the total "back-up" volume of the charging port, intake port, charge transmission ducting etc. is great relative to the volume of the charging chamber
c. The charge was slightly cooled on its way from the pre-compressor, yet the pressure sensor has maintained the pressure. To quote some typical figures, with the pressure sensor set at 150 psig, the temperature of the charge would be approximately 1200 degrees Rankin. This temperature would cool in transit, or may be cooled purposely, resulting in a denser 150 psig charge, possibly at 1100 degrees Rankin; this would be below the safe temperature of 1200 degrees Rankin; with cooling the press may be raised.

In connection with the above, it may be appropriate at this time to discuss the results of heat loss by the charge on its way from the pre-compressor to the combustion chamber. This loss of heat may readily be prevented by insulating the transfer ducting, but cooling the pre-compressed charge, without loss in pressure may improve the efficiency of the engine. The denser charge, or in other words, the required amount of fuel plus the required amount of oxygen, for a certain power output, would be "packed" in a smaller volume "charging" chamber. Thus the ratio between the initial volume upon ignition, and the final volume, after expansion, of the combustion chamber would be greater for a cooled charge; in other words, the expansion ratio would be greater and this could mean a greater amount of energy extracted from the same weight of charge. The gain in energy may more than off-set the loss in energy caused by cooling the pre-compressed gas charge, as described in detail hereinafter.

To return to FIG. 8, the cylinder block 83 is headless and has the cylinder bore 84 well extended beyond the top dead center position of piston 90. The top portion of the cylinder bore contains a cylindrical valve carrier 91, which is reciprocably disposed within limits. The uppermost portion of the cylinder bore is provided with an internal thread and carries a hollow cylindrical jackscrew 92. Jackscrew 92 engages valve carrier 91 on a ledge formed around the upper portion of valve carrier 91, with a hardened steel wear ring 93 ensuring longevity. Jackscrew 92 is locked to valve carrier 91 by retaining ring 94, in a rotatable manner. Jackscrew 92 is provided with an integral worm gear 95 which is engaged by two worms 96, which are connected with a shaft to a rotary power actuator, not shown. Rotation of worms 96, thus will raise or lower valve carrier 91 as required, with the raising or lowering constituting a geometric variation of the expansion ratio, and a variation in power output by virtue of varying the charge admission at constant maximum permissible pressure. Since no compression takes place in the power cylinders of this engine, the "normal" compression ratio will be referred to as expansion ratio in this disclosure. Besides, it is really the expansion ratio which determines thermal efficiency.

Valve carrier 91 contains two valves, a charge and spring biased admission valve 97 and an exhaust valve 98. These valves are shown with mechanical valve lash adjustment, shims in the case of 97 and threads in the case of 98. The overhead camshaft 99 is provided with extra large diameter minor diameter lobes to actuate the valves 97, 98 directly via rollers, admission valve roller 102, exhaust valve roller 103. The admission valve lobe is 100, the exhaust valve lobe is 101. Since the overhead camshaft 99 is rotatably supported by the cylinder block 83, the relationship between the top position of the piston 90 and the bottom position of the valves, 97, 98 is fixed and no interference will occur at any setting of valve carrier 91. At a "minimum volume" setting, idling, the lift of valves 97, 98 will be minimal, with admission valve 97 just lifting enough to admit sufficient charge for idling. The ignition would be advanced accordingly. The exhaust valve 98 would have an extra high lift with a rapid closing so that even at idling setting, the exhaust would be expelled readily. Auxiliary exhaust ports 104, located all around the cylinder walls, at the bottom position of the piston 90, would allow the bulk of the exhaust gasses to escape and a ventury type extractor could advantageously be used to create a slight vacuum in the exhaust manifold aiding evacuation of exhaust remanants during the exhaust expulsion stroke, the upstroke of piston 90.

It should be noted that, for illustrative purposes only, overhead camshaft 99 and valve carrier 91 have been rotated ninety degrees from their actual position. In actuality, overhead camshaft 99 would be parallel with the axis of crankshaft 86. Overhead camshaft 99 is driven at engine speed by conventional means, preferably a timing belt, a silent chain or a roller chain.

Admission valve 97 is charge biased in the closed position, with a greatly increased closing bias after opening. This aids rapid closing. Components making up admission valve 97 are: guide sleeve 105, lower head 106, spring retaining collar 107, bias spring 108, spring support tube 109, cam follower guide 110, head retainer 111, cam follower 112, intake valve roller 102 and roller pin 113. Spring support tube 109 threads into a collar on cam follower guide 110, which is retained in valve carrier 91 by admission valve retaining ring 114. Adjustment shims 115 complete the admission valve assembly. Rotation about the long axis of the admission valve 97, is prevented by the bifurcated top end of cam follower guide 110. Exhaust valve 98, is carried directly in valve carrier 91 and comprises a poppet type exhaust valve 98, with a threaded end portion, which engages a bifurcated exhaust cam follower 106A. Exhaust valve spring 107 biases the valve in the closed position and is extra long to accommodate a high lifting action. A bifurcated guide bore is provided directly in the casing of valve carrier 91 and this keeps exhaust valve roller 103 perfectly aligned. Exhaust valve roller pin 108A completes the assembly. Adjustment is carried out by lifting valve carrier 91 into the high position and by engaging the stem of the exhaust valve with a special tool to rotate the valve through the exhaust ports. Removal of the exhaust manifold would be required.

A charge admission port 109A and a static exhaust port 110A, are provided in the top portion of cylinder block 83. Valve carrier 91 is provided with an admission port and an exhaust port closed by their respective valves. Sealing rings 111A, vertical separator seals and oil seals complete the sealing arrangement for valve carrier 91. Rotation of valve carrier 91 is prevented by locator pins 112A engaging locator pin guide 113A which is bolted to the cylinder block 83. Spark plugs 114A are carried by valve carrier 91, which spark plugs are electrically connected outward via an oil tight insulated conductor. Valve carrier 91 is cooled by injection of engine lube oil into the interior.

Figure 7:
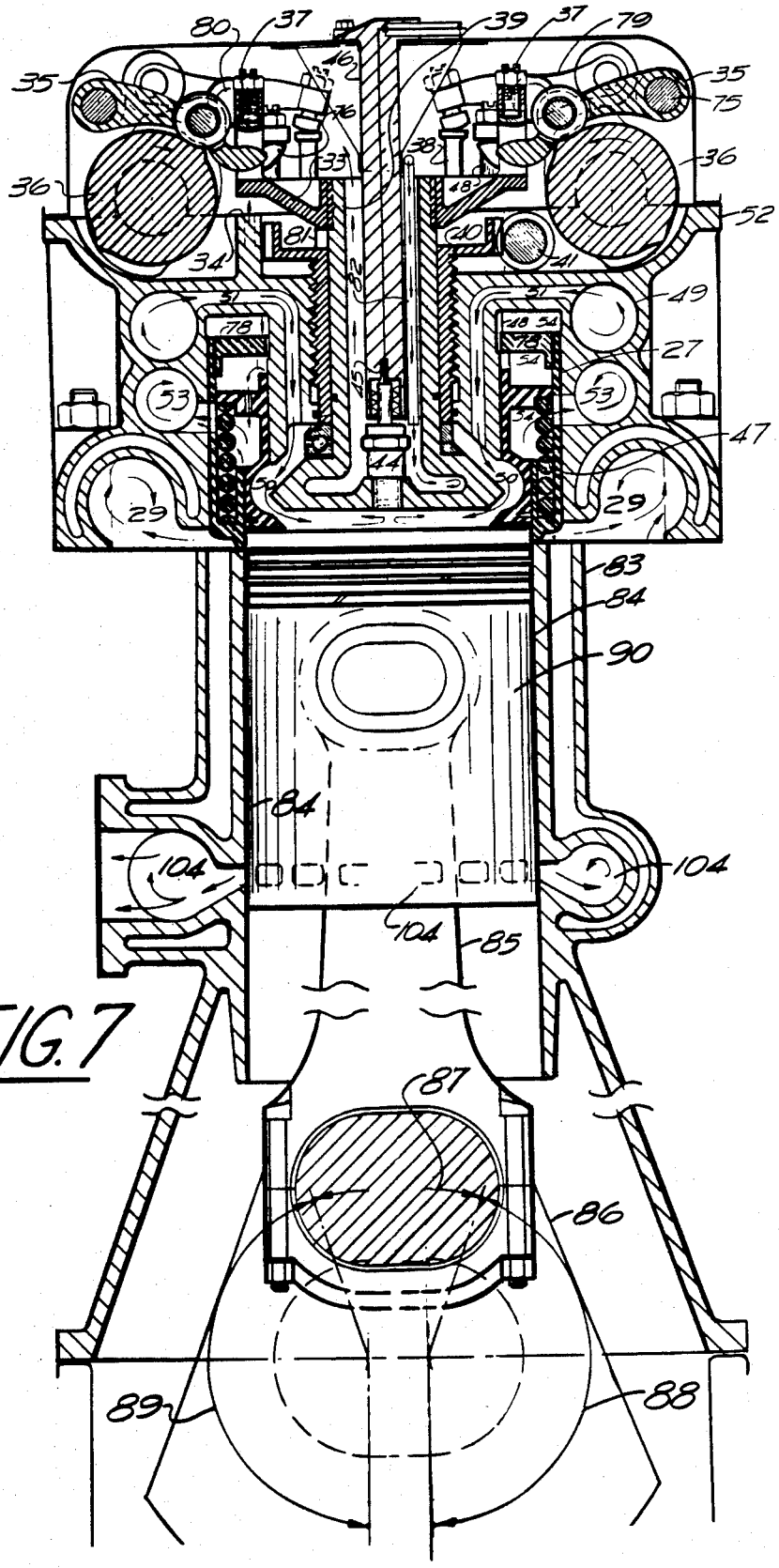
FIG. 7 is a cross sectional view of the engine formed according to an alternative crankshaft driven version of the invention using the novel cylinder head and valve train shown in FIG. 4.

The crankshaft driven version of the invention, illustrated in FIGS. 7 and FIG. 8 is provided with a crankshaft driven positive displacement charge pre-compressor of the piston variety with self actuating inlet valves and outlet valves, identical in principle to the charge pre-compressor illustrated for FIGS. 1 and 3. The charge pre-compressor compresses the charge, or air, to pre-determined values, depending on fuel characteristics, and depending on whether, after cooling is selected; the main considerations being the ignition temperature of the fuel to be used, the point of admission of fuel, and the relationship between energy lost by after cooling and energy gained by a denser charge and a resulting greater expansion ratio. A pressure sensor in the transmission duct 115A would direct the unloading of the charge pre-compressor by means of an unloading device acting on the self actuating inlet valve of the pre-compressor; with the timing of the unloading action taking place at the bottom of the stroke of the pre-compressor. Thus at idling, the compressor intake valve would be unloading during most of the bottom portion of the stroke, with the effective compressing stroke increasing as the engine power output increases. All components cited for the pre-compression of the charge are standard commercially available ports for air compressors and well developed compressed air technology would guide the arrangement of the charge pre-compressor and associated controls. The volume of the high pressure "reservoir" made up by transmission duct 115A would be sufficient to smoothen out pressure variations and to maintain the preset pressure values. Any of the high pressure charge escaping past the sealing rings 111A would be returned to the pre-compressor via the engines positive crankcase ventilation system. The maximum capacity of the charge pre-compressor may be chosen so that, at the most used power range, the weight of the pre-compressed charge admitted into the "charging chamber" of the cylinder, would be such that near full expansion of the combusting charge takes place; with the pre-compressed charge being at constant maximum and pre-set values as already disclosed. Thus, at the most used power range, possibly 60 to 75% of full throttle in small vehicles, nearly full gas expansion, without wasted excessive motion and without a high vacuum in the inlet of the pre-compressor, may be achieved; this being one of the objects and advantages of the invention. The charge and spring biased admission valve 97, of course, may be replaced by a desmodromic actuated valve, ensuring positive valve action, a great advantage at higher speeds of the engine. This crankshaft driven version of the invention therefore may achieve four objects of the invention, namely:

a. Near full expansion without excessive wasted motion in the most used power range. Conventional four cycle engines may achieve near full expansion at reduced power outputs by manipulating the inlet valves, or otherwise limiting the weight of the charge admitted but this results in excessive wasted motion and/or high vacuums.

b. Maximum gas expansion ratios at all or nearly all power settings. This is achieved by virtue of the fact that the density of the charge is at constant maximum values, relative to the temperature permitted by the fuel to be used. This is identical to a gasoline four cycle engine with a variable geometric compression ratio, which would result in a compressed charge of maximum permissible temperature values under all operating conditions.

c. Divorcing light duty functions from heavy duty components. Remove the intake and compression functions from the power cylinders with the power piston delivering power on every downstroke, yet maintain positive charging and positive exhausting without the waste and inefficiency of the conventional two cycle principle.

d. A simple one piece cylinder block with simple machining operations.

Figure 6:
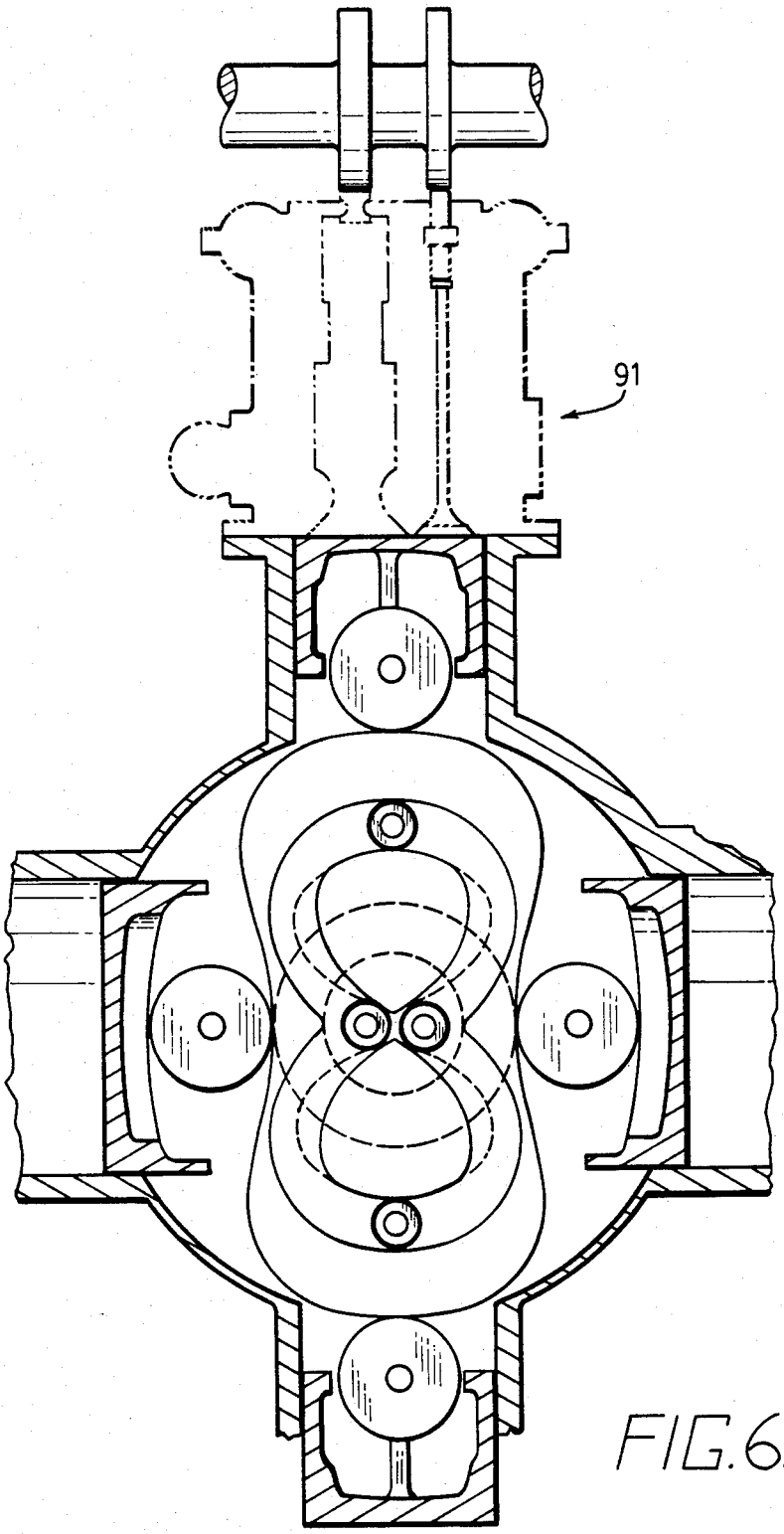
FIG. 6 is a schematic view of an engine using a cam shaft compressor arrangement of FIG. 1 with the intake and exhaust valving for power pistons as generally shown in FIG. 8.

FIG. 6, illustrates the radial cam driven version of this invention using the variable valve carrier 91 as illustrated and described for FIG. 8. The description applicable for FIG. 8 applies to this embodiment, with all components driven by the crankshaft of FIG. 8, driven by the radial power camshaft of FIGS. 1 and 3.

FIG. 7 illustrates the crankshaft driven version of FIG. 8, equipped with the novel cylinderhead as illustrated in FIG. 4. The description of the action of the novel head as per illustration 4 applies; with, alternatively, a telescoping head or a non-telescoping head 32 possible. Desmodromic actuation of the admission sleeve valve and exhaust sleeve valve may be advantageously deployed.

FIG. 9 illustrates a "horizontal" cross section of valve carrier 91 illustrated in FIG. 4, taken on Plane A—A. Locator pins 112A are clearly shown, as well as the access spaces for spark plugs 114A.

FIG. 10 illustrates valve carrier 91, and is taken on Plane B—B in FIG. 4. Spark plugs 114A are illustrated as well as sealing rings 111A.

FIG. 11 illustrates the locator pins 112A and locator pin guide 113A and is taken on Plane C—C in FIG. 9.

Figure 12:
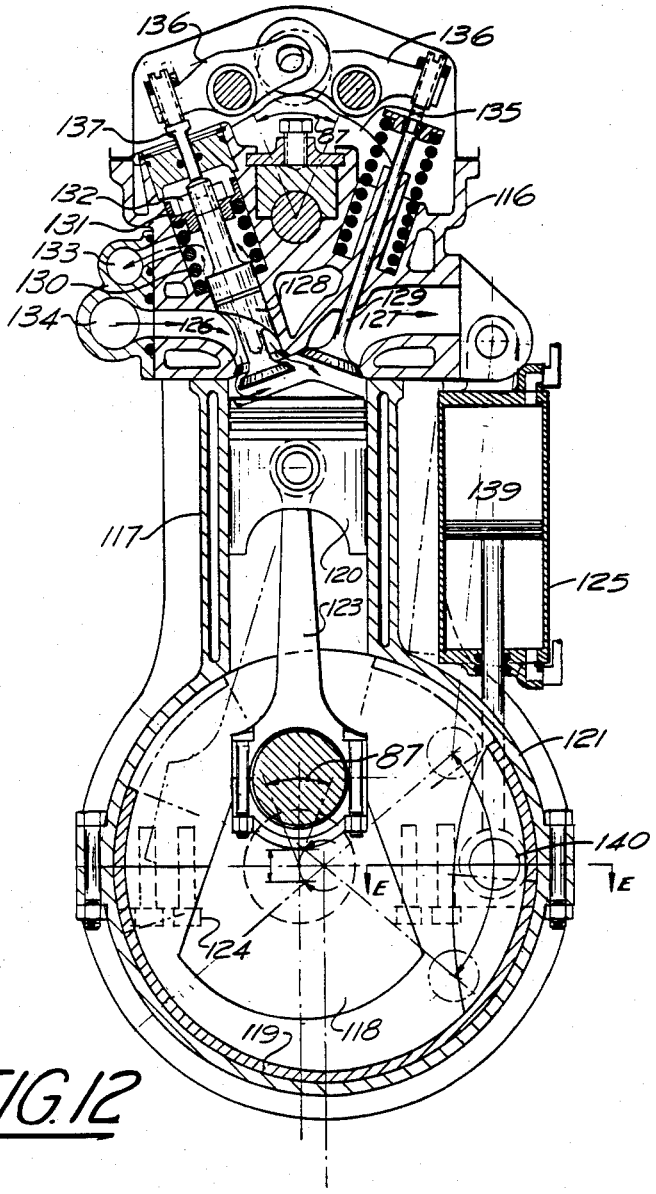
FIG. 12 is a cross sectional view of the engine formed according to a third alternative crankshaft driven version of the invention.

Turning now to FIG. 12, there is shown a transverse cross section of the second alternative crankshaft driven embodiment of the invention. Reciprocative cylindrical valve carrier 91 is eliminated; a more or less conventional cylinder head 116, closes the top of the cylinder block 117. A geometric variation of the volume of the "charging chamber", (in this disclosure the "charging chamber" defines the combustion chamber with the piston in the approximate top position,) is achieved by mounting crankshaft 118 in an off-set or eccentric crankshaft carrier 119, the segmented rotation of which will raise or lower crankshaft 118, and therewith piston 120, within limits. Crankshaft carrier 119 comprises a cylindrical casting, with the axis of the cylindrically machined outside surface laterally off-set from the axis of the crankshaft. Similarly, the cylindrically machined inside diameter of the crankcase 121 is laterally off-set from the axis of the crankshaft 118. Crankshaft carrier 119 fits closely in crankcase 121 and, both are split on the "horizontal" center plane, to allow installation of main bearings 122, crankshaft 118, and connecting rods 123. Both halves of crankshaft carrier 119 are bolted together by bolts 124, and the assembly is installed in the upper half of crankcase 121. Note that the upper half of crankshaft carrier 119 is provided with generously sized openings in the top surface to clear connecting rods 123 and pistons 120. In essence, crankshaft carrier thus resembles a partioned drum, with the transverse partitions supporting the main bearings 122.

The crankshaft carrier actuator 125, for which several alternative embodiments are disclosed, is connected, and the lower half of crankcase 121 is installed. The extremely generous contact surface and the lubricating oil present should make segmental rotation easy, while the great mechanical advantage of the point of actuation should make the force on the actuator 125 relatively reasonable. Cylinder head 116 is provided with a high pressure charge admission port 126 and an exhaust port 127, blocked by charge admission valve 128 and exhaust valve 129 respectively. Admission valve 128 comprises a spool type valve with a poppet type head, with the spool carved out so that in the open position a streamlined flow path is generated for the charge; this streamlining is optional, of course. The spool has a diameter which is equal to the small diameter of the valve seat, resulting in neutral biasing while closed. Once opened, the high pressure charge admitted to the charging chamber will bias the admission valve 128 powerfully towards the closing position, aiding in rapid closing. Admission valve 128 is biased by an extra strong valve spring 130, retained by spring retainer 131 which acts as a guide also, and nut 132.

Admission valve 128 is hollow to reduce its inertia, while the valve guide bore is ventilated back to the intake of the charge pre-compressor via ventilation duct 133, which is combined with charge admission duct 134. Valve camshaft 135 is provided with extra large diameter actuation cams to ensure rapid action, and is carried between the valves to reduce engine profile. Valve camshaft 135 runs at engine speed, being driven by a timing belt, silent chain or roller chain, the drive being provided with a tensioner.

Roller equipped valve rockers 136 engage the valves, with the admission valve 128 being actuated via a short push-rod 137, allowing isolation of the valve guide bore for ventilation purposes. Spark plugs 138 are located under the rocker cover and are provided with oil tight insulators and electrical conductors. FIGS. 15, 16, 17 and 18 are taken on Plane E—E in FIG. 12 and illustrate the alternative actuating means for crankshaft carrier 119. FIGS. 12 and 15 illustrate the fluid power actuator 139 and its pin 140. FIG. 16 illustrates worm gear actuator 141 with worm screw teeth generated in the outside cylindrical surface of crankshaft carrier 119. FIG. 17 illustrates spur gear and pinion actuator 142; again with gear teeth generated in the crankshaft carrier 119. FIG. 18 illustrates toothed rack actuator 143 with engaging teeth generated in crankshaft carrier 119.

Figure 13:
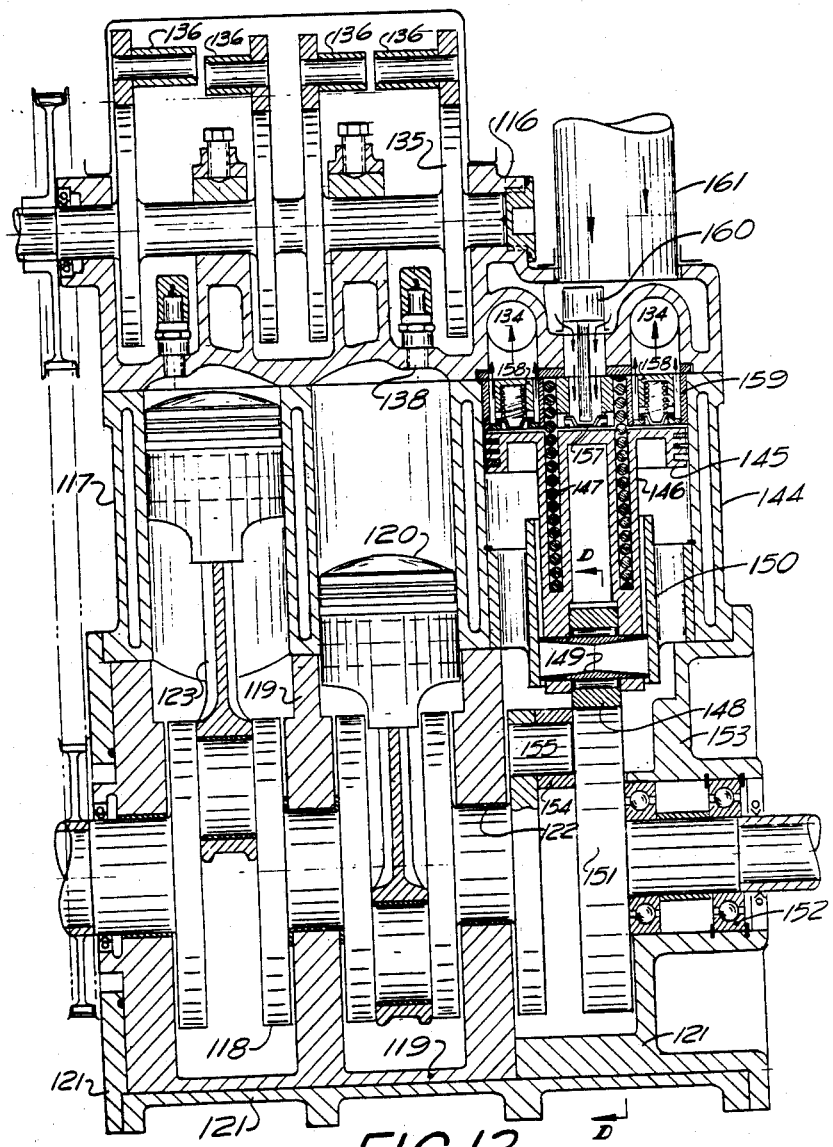
FIG. 13 is a longitudinal cross sectional view of the engine shown in FIG. 12.

Proceeding to FIG. 13, there is shown the longitudinal cross section of the engine embodiment of the invention illustrated in FIG. 12. Cylinder block 117 is provided with a charge pre-compressor cylinder 144 in which compressor piston 145 is reciprocatively disposed. Piston 145 is provided with an integral coaxial cylindrical bottom extension, piston extension 146. Piston extension 146 serves these functions:

a. to contain piston bias spring 147, which biases and returns piston 145 towards the bottom of its stroke
b. to guide piston 145 in straight line motion
c. to carry the actuating roller 148 on pin 149
d. to prevent rotation of piston 145 by extending pin 149 into vertical slots machined in piston guide 150.

Piston guide 150 is a cylindrical piece, locked in the bottom portion of the compressor cylinder and provided with axial ventilation holes, to ventilate the space below piston 145. Actuating roller 148 engages the top surface of a double lobed cam, compressor cam 151 which is supported on a cantilevered integral shaft and two ball bearings 152, in a crankcase end cover 153. The axis of compressor cam 151 is axially in line with the center position of the axis of crank shaft 118, and the axis of compressor cam 151 is fixed. Compressor cam 151 is driven by a trailing connecting link 154 from crankshaft 118. Connecting link 154 pivots on a driver pin 155, in crankshaft 118 and a driven pin 156 in compressor cam 151. This driving arrangement is simple, compact, of large torque capacity and efficient; it allows crankshaft 118 to move eccentrically within limits. This is shown clearly in FIG. 14 which illustrates Section E—E in FIG. 13. The capacity of the charge pre-compressor may be changed by changing the stroke provided by the compressor cam 151. The preferred embodiment utilizes a compressor with a displacement per stroke which will deliver a charge just sufficient to combust and expand to near atmospheric pressure at maximum power delivery. This charge would be approximately half the charge taken in by a normal four cycle engine at wide open throttle. Alternatively, the capacity of the pre-compressor may be chosen to suit the intended application of the engine.

A complement of self-acting inlet valves 157 and outlet valves 158 are carried in a valve adapter 159, which is retained and locked in the top of the compressor cylinder bore by an extension of cylinder head 116. A pressure sensor, not shown, signals unloader 160 to depress inlet valves 157 during a certain bottom portion of the compressor piston stroke, while a relief valve, not shown, would relieve excess pressure back into the compressor inlet duct 161. The compressor piston 145 is in the top position every time a power piston 120 is in the top position.

Figure 19:
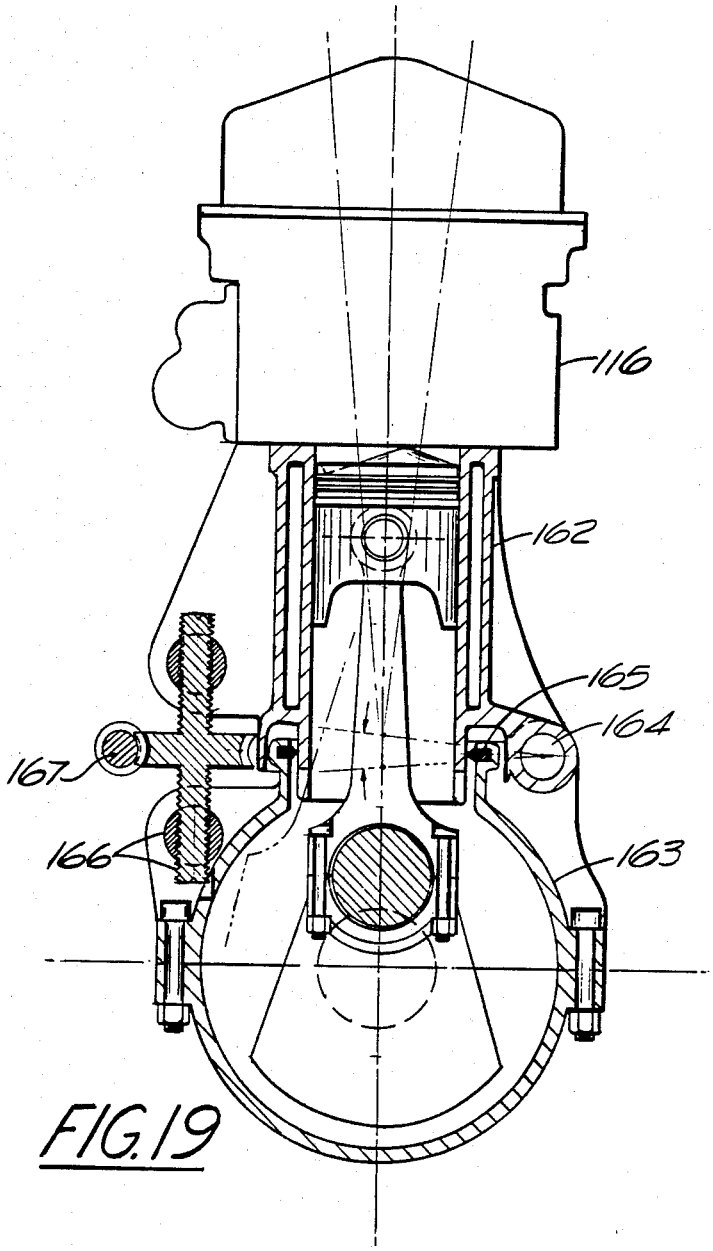
FIG. 19 is a cross sectional view of the engine formed according to the fourth alternative crankshaft driven version of the invention.

Turning now to FIG. 19, there is shown a transverse cross section of the third alternative crankshaft driven embodiment of the invention. In this embodiment, variation of the geometric expansion ratio is achieved by separating the cylinder block 162 and the crankcase 163 and by pivoting the separated components about longitudinal hinge pin 164, which is parallel to the axis of the crankshaft. Extra flexible elastomer seals 165, provide oil tight separation, while actuation is provided by a turnbuckle 166, driven by a worm screw and gear power actuator 167. Turnbuckle 166 is conventional in principle, consisting of a threaded rod provided with left hand thread on one half and right hand thread on the other half, the rod halves engaging threaded cylindrical nuts, free to pivot in support eyes cast on the respective components. Alternatively, the worm gear and worm screw actuator may be dispensed with, the turnbuckle provided with multiple start steep pitch threads so that fractional rotation of same will provide the required raising and lowering of the cylinder block; thus would allow the use of a fluid power cylinder actuator. Alternatively, the turnbuckle actuator may be replaced by a C-clamp threaded actuator; a vise-like threaded actuator; and actuator based on the wedge principle; a Saginaw ball bearing nut actuator; a hydraulic cylinder or any other linear actuator capable of handling the forces encountered and capable of being power actuated in a linear relationship with the throttle position of the vehicle. It may be appropriate to mention again that the power output of the engine is varied by varying the geometric volume of the charging chamber in the cylinder, with the charge being admitted at constant maximum permissible pressure and temperature for the fuel to be used, except possibly near the bottom of the output range where lower pressures may smoothen operation.

The remainder of the engine is identical to the engine illustrated in FIGS. 12, 13 and 14, with of course, eccentric crankshaft carrier 119 omitted. The pre-compressor cylinder 144 and compressor cam 151 are carried solidly by cylinder block 162, while trailing connecting link 154 is similarly used to provide the flexible eccentric driving connection required between the crankshaft and the compressor cam.

Figures 20, 21:
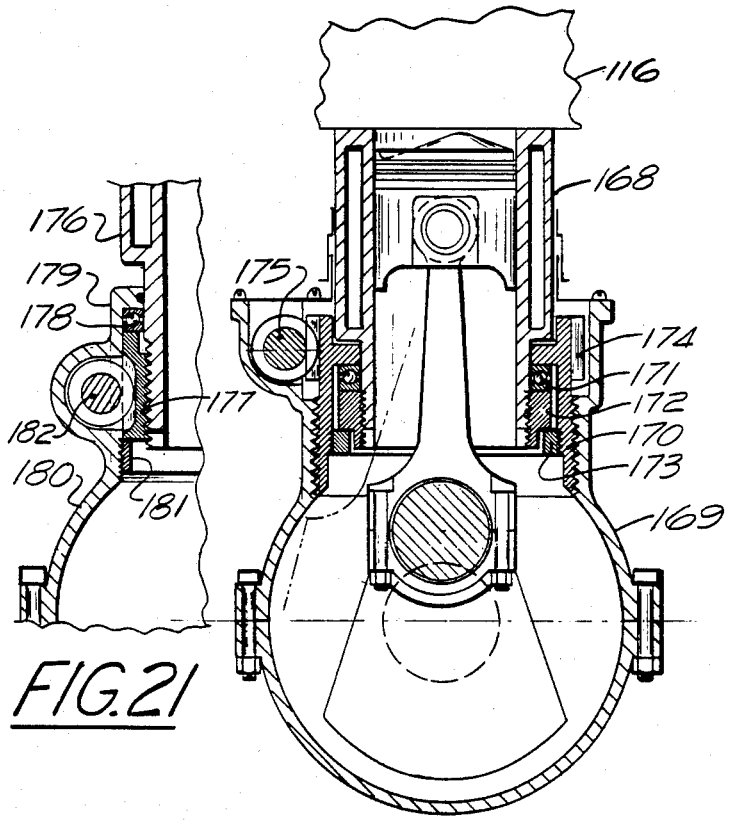
FIG. 20 is a fifth alternative.
FIG. 21 is a sixth alternative.

Turning now to FIG. 20 there is shown a transverse cross section of the fourth alternative crankshaft driven embodiment of the invention. In this embodiment, variation of the geometric expansion ratio is achieved by separating the cylinder block 168 and the crankcase 169 and by reciprocating the entire cylinder block 168 and cylinder head 119 together, within limits, by means of a hollow cylindrical jackscrew 170, which is externally threaded to match a thread, coaxial about the cylinder axis, machined in an annular collar in the top of the cylinder block. Jackscrew 170 engages a ball thrust bearing 171, or the like, installed on top of a ledge 172, which is mounted by way of a threaded engagement to the bottom cylindrical portion of the cylinder, and locked in place. In internal retaining ring 173, rotatably engages the bottom surface of ledge 172, and is mounted securely to the inside cylindrical surface of jackscrew 170, and locked in place, to same. An integral worm gear, 174 engages power worm screw actuator 175. Alternatively, worm gear 174 and screw actuator 175 may be replaced by a spur gear and pinion actuator, a spur gear and toothed rack actuator, a sprocket and chain actuator, a bevel gear and bevel pinion actuator.

Alternatively, the external thread on jackscrew 170 may be multiple start, steep pitch variety, whereby fractional rotation of said jackscrew will provide the required raising and lowering of the cylinder block; this would allow the use of a fluid power cylinder actuator. The remainder of the engine is identical to the engine illustrated in FIGS. 12, 13 and 14, with of course, eccentric crankshaft carrier 119 omitted. The pre-compressor cylinder 144 and compressor cam 151 is carried solidly by cylinder block 162, while trailing connecting link 154 is similarly used to provide the flexible eccentric driving connection required between the crankshaft and the compressor cam.

Turning now to FIG. 21, an alternative, more compact arrangement of the engine illustrated in FIG. 20 is disclosed. In this embodiment, cylinder block 176 is machined to provide male threads around the bottom cylindrical portion of the cylinder. A hollow cylindrical jackscrew 177, is internally threaded to match the said male threads and is provided with a ball thrust bearing 178, or the like, on its top surface. A cylindrical collar like extension 179 on crankcase 180, is internally machined to match the outside diameters of jackscrew 177 and ball thrust bearing 178, and is provided with an inward facing flange on the top edge. A retaining ring 181 rotatably engages the bottom surface of jackscrew 177 and is securely mounted in collar extension 179. An integral worm gear, machined in the outside surface of jackscrew 177, engages a worm power actuator 182. Alternatively, the worm gear and worm power actuator may be replaced by a spur gear and pinion actuator, a spur gear and toothed rack actuator, a sprocket and chain actuator, a bevel gear and bevel pinion actuator.

Alternatively, the external thread on jackscrew 170 may be multiple start, steep pitch variety, whereby fractional rotation of said jackscrew will provide the required raising and lowering of the cylinder block; this would allow the use of a fluid power cylinder actuator. The remainder of the engine is identical to the engine illustrated in FIGS. 12, 13 and 14, with of course, eccentric crankshaft carrier 119 omitted. The pre-compressor cylinder 144 and compressor cam 151 is carried solidly by cylinder block 162, while trailing connecting link 154 is similarly used to provide the flexible eccentric driving connection required between the crankshaft and the compressor cam.

Illustrated embodiments as illustrated in this disclosure may be executed with minor modifications as two cycle or four cycle engines, and such two cycle or four cycle engines are included in the scope of this invention, for particular inventive embodiments disclosed.

Figures 22, 22A, 22B, 22C:
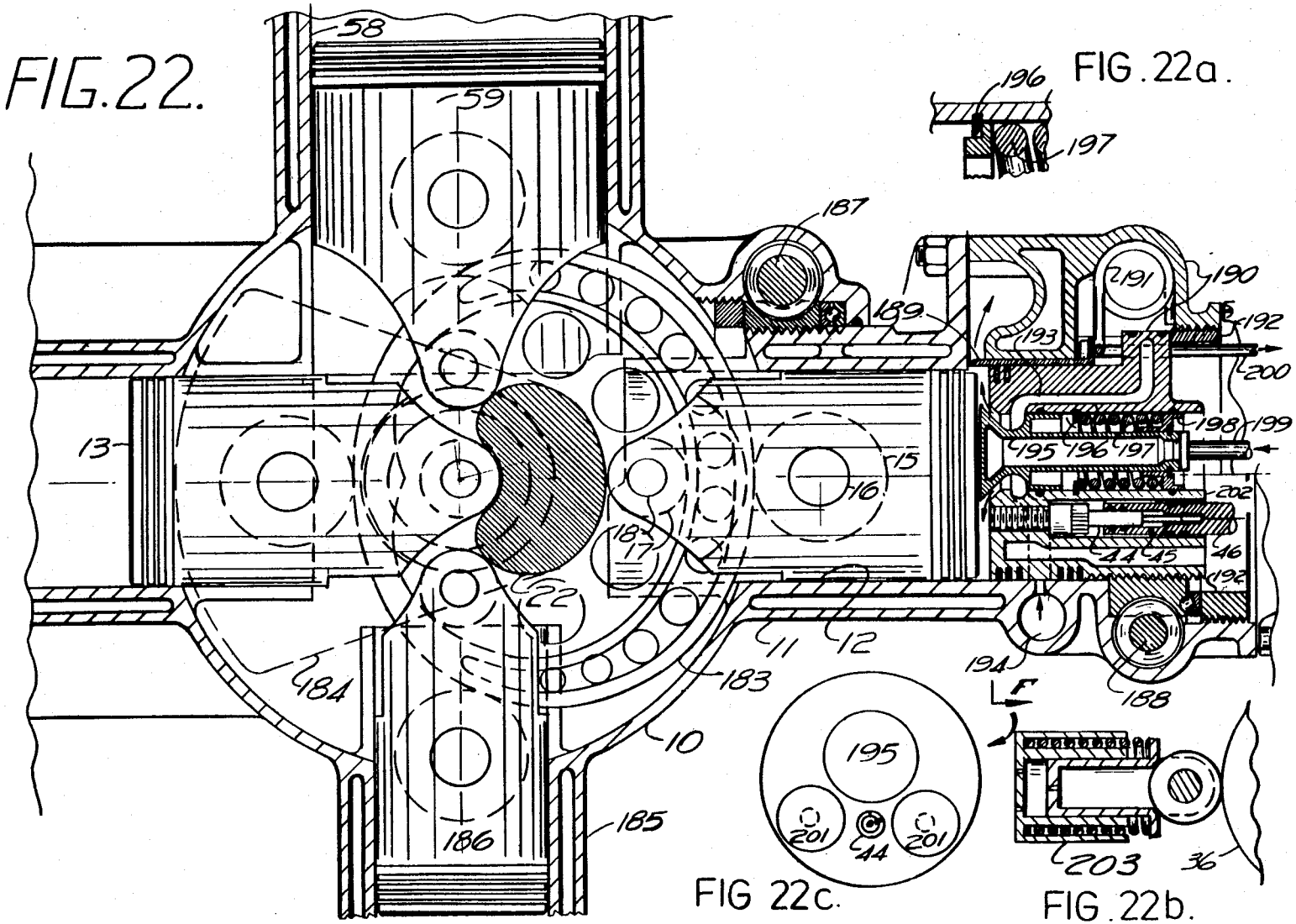
FIG. 22 shows a single lobed cam version.
FIG. 22*a* is a partial section of an admission valve used in FIG. 22.
FIG. 22*b* is a partial section of an oil filled impact absorbing cam follower.
FIG. 22*c* is a horizontal section of the admission and the exhaust valves used in the engine of FIG. 22.

FIG. 22 illustrates the single lobed radial power cam version of the embodiment shown in FIG. 1. The advantages of a single lobe, 183 are alternate firing of opposed pistons, and including the normal advantages of a radial cam, such as several pistons being served by one motion converter, uniform deceleration and acceleration, motionless retention of the piston in the top position or bottom position. The disadvantage is dynamic imbalance with all reactions adding up requiring a counter balanced power shaft, using counter balance weight 184. This introduces secondary imbalances which, of course, are off-set and cancelled by the imbalance of the compressor piston, being located at 90 degrees from the power pistons.

Therefore, a counter balanced single lobed version can be relatively smooth, either in an opposed twin or a flat four layout; the latter employing twin power cams. The outward transition pieces, 23 in FIGS. 2 and 3 could be integrated into counter balance weights, while connecting bridge 22 will be kidney-shaped. In a flat four version, the number of power impulses will equal those of a four cylinder four cycle engine; therefore, from a balancing and a power impulse view point, a flat four single lobed counter balance version can be a very sound engine, with all the advantages of the novel three cycle, varying combustion chamber volume, maximum expansion ratio, and deep expansion without excessive waste, as disclosed. The advantage of a cam power shaft for the novel three cycle process is retention of the piston in the top charging position, although, as disclosed, a crankshaft may readily be employed. In this version, the front compressor cylinder would serve one front and one rear cylinder and vise versa. Summing up this embodiment, a twin cylinder, single cam version would equal the power of a four cylinder four cycle; would have a power impulse every ninety degrees of shaft rotation; the same as a four cylinder four cycle; would weigh considerably less; and would have the great advantages of maximum gas expansion under all, or nearly all power output, without the complication of precision measurement of charge mass flow, which four cycle, varying geometric compression ratio engines require; with the final advantage of deep expansion without excessive waste motion, at the most used power output range; with no new technology required. A four cylinder, four cycle engine with maximum gas expansion under all power output, will require four variable geometric compression ratio cylinder heads; the embodiment discussed here, as a twin cylinder, would require only two. For the extra complexity of the compressor, the twin cylinder embodiment would have these advantages over a four cylinder, four cycle engine as discussed:

2 less power cylinders with crankthrows etc.

2 less variable geometric compression ratio cylinder heads

No complex charge mass measurement and control.

Deep expansion without excessive wasted motion at the most used power output range.

Deep expansion in the most used power range, assumed to be at 75% of full power output in future, smaller automobiles, when provided in conventional four cycle engines, will require a reduction of charge taken in of 50%. It is known that a full charge, in conventional engines, requires a stroke which is twice the available stroke, to expand the gas to 20 psig, with 20 psig for practical purposes assumed to be sufficiently low. Thus limiting the intake, by manipulating intake valve timing, to 50%, would allow deep expansion with the available stroke. This would result in an additional 180 degrees of wasted motion. A conventional four stroke requires 720 degrees of rotation to complete one cycle per cylinder. The power stroke may use 180 degrees of rotation leaving 540 degrees of recycling motion. The exhaust stroke may use 180 degrees, leaving 320 degrees for the recharging cycle. Reducing the charge intake to 50% with intake valve manipulation, thus results in 180 degrees of wasted motion.

The novel three cycle process of this invention requires 360 degrees of rotation to complete one cycle, with another 360 degrees of compressor rotation shared between two cylinders, resulting in 540 degrees of motion per power cylinder per cycle. Since the compressor may readily be sized to operate at 75% capacity in the most used power range, the wasted motion in this range would be another 25% of 180 degrees which equals 45 degrees per power cylinder, for a total score of 540 degrees of motion plus 45 degrees of wasted motion. The conventional engine cited above had a score of 720 degrees of motion plus 180 degrees of wasted motion. Employing a double lobed cam as illustrated in FIG. 1, dramatically improves the required motion, and it is reduced to 270 degrees of motion plus 22½ degrees of wasted motion per power cylinder per cycle; at the assumed 75% power setting. Piston unit area travel may be a better criterion, and in this respect the novel three cycle engine of this invention scores even better with the single large compressor piston having 66% less friction area, for identical volumetric displacement, than the two pistons it replaces.

Returning to FIG. 22, counter balance weight 184 is incorporated with outward transition pieces, 23, shown in FIGS. 2 and 3. This transition pieces, 23 would be moved outward slightly so that counter balance weight 184 clears the compressor cylinder 58. A "flat four" version would have single lobed power cams 183, 180 degrees out of phase, resulting in a statically balanced engine. Dynamically, a rocking couple would be set up about the center of mass of the engine and counter balance weights 184, being outwardly located farthest from the center of mass, could be reduced in size sharply, for a "flat four" layout.

For special applications, where a denser charge is advantageous or required, including diesel versions, a second stage compressor cylinder 185 and piston 186 may be added opposite the first stage compressor cylinder 58 and piston 59. Inter cooling could be advantageous in certain applications. The first stage would compress the charge to a pressure equivalent to the square root of the absolute end pressure. It is known that efficiency is optimum if all stages have the same pressure ratio.

The second alternative combustion chamber volume adjusting means for radial cam driven embodiments is shown as numeral 187, details of which are given in FIG. 21. The first alternative C.C.V.A. means is shown in FIG. 4. The third alternative combustion chamber volume adjusting means is shown as numeral 188, details of which are disclosed in FIG. 8 and FIG. 21. Note that two alternative embodiments for engine aspiration are shown in FIG. 22. The upper half of the cylinder head illustrates an exhaust sleeve valve 189 deployed in a two piece cylinder head 190, locked together by retaining ring 192. A number of hairpin valve springs 191 bias exhaust sleeve valve 189 downwardly to the closed position, while pull rods, 200, engage with valve actuating means, of which a host of alternatives may be used; radial cam and crankshaft versions of this invention may have a valve actuating cam directly installed on the power shaft and push rods and valve rockers may be advantageously utilized if the inertia of the push rods etc. is kept down. Charge admission port 193 communicates with the outlet of charge pre-compressor, 58, 59, using a flexible hose or pressure tight sliding joint, if C.C.V.A. means 187 is used. With C.C.V.A. means 188, charge transmission duct 194 would communicate with the charge pre-compressor, and with charge admission duct 193. One of the objects of this invention is to provide a low inertia, simple spool type charge admission valve, operating in a simple plain bore guide hole. In this instance, C.C.V.A. stands for-combustion chamber volume adjusting.

The embodiment of this object is illustrated as numeral 195, admission valve, and this embodiment is included in the scope of this invention. A straight bored guide hole is provided with a conical valve seat, a radial annular charge admission port directly above said valve seat, a snap ring groove for a heavy duty snap-ring 196, and seal ring grooves. Valve bias spring 197, extra strong, biases admission valve 195, to the closed position and is retained by spring retainer 198, which tightly encircles a snap-ring which locks spring retainer 198 to the stem of admission valve 195. Dislodging of the said snap-ring is prevented by tight encirclement of spring retainer 198. Depressing spring retainer 198 allows installation and removal of said snap-ring. Alternatively, conventional tapered valve keepers may replace said snap-ring. Admission valve 195 may be actuated by any of the common methods; the stem of said valve may be extended to carry a roller for direct engagement with a valve actuation cam. A common rocker arm end may engage said valve. A common inverted bucket cam follower or a push rod, 199 may engage said valve for actuation. If exhaust sleeve valve 189 is not used, conventional poppet type exhaust valve or valves 201 are employed, with details of the exhaust routing in valve carrier head 202, disclosed in FIG. 8. Spark plug 44, sliding sealed electrical joint 45 and insulated rod 46 provide an oiltight ignition means. The relationship between the maximum bottom position of the valves and the maximum top position of the piston may be fixed resulting in shorter admission time as the combustion chamber is reduced in volume, and increased valve lash, in certain embodiments. To avoid wear due to impact with this increasing valve lash, a simple spring biased oil cushioned, telescopic cam follower, preferably roller equipped, may maintain constant contact with the face of the cam lobe, with the impact occurring internally, and being oil cushioned. Illustrated in FIG. 22, as 203, impact absorbing cam follower. To reduce imbalance the single lobed cam 183, has a deeply indented flange and is provided with lightening holes, as shown. The inner head of two piece head 190 may be reciprocal in exhaust sleeve 189 and in the outer, now static, head. Retaining ring 192 may be executed as C.C.V.A. means 188, or as jackscrew 92 in FIG. 8, to thereby form yet another alternative C.C.V.A. means.

Note: regarding the remarks on cooling the pre-compressed charge:

It is known that the following conditions prevail in a gas engine and a diesel of identical size and fuel intake, all being equal, with the gasoline engine having a geometric compression ratio of 5 to 1 and the diesel engine having a 15 to 1 ratio.

| | Gasoline Engine | Diesel Engine |
|---|---|---|
| Condition | | |
| Intake Pressure | 14.7 psig | 14.7 psig |
| Intake Temperature | 538 deg. R | 538 deg. R |
| Final Compression | | |
| Pressure | 150 psig | 500 psig |
| Temperature | 1200 deg. R | 1480 deg. R |
| Ignition | | |
| Pressure | 1100 psig | 1100 psig |
| Temperature | 5000 deg. R | 5000 deg. R |
| Exhaust | | |
| Pressure | 100 psig | 90 psig |
| Temperature | 3000 deg. R | 1800 deg. R |

By increasing the charge density and decreasing the initial pre-expansion combustion chamber volume by a factor of 3, the charge expansion ratio has been improved by 1200 degrees R, or more than a 50% improvement of diesel over gasoline engine. By lowering the compression temperature by 280 degrees R, (1480–1200 deg. R,) or more, considerably higher compression pressures are likely allowable for gasoline engines, which would result in much improved expansion ratios. It would appear that the energy lost by cooling the charge, 280 deg. R, or more, and increasing the density, would be more than gained by the additional extraction of 1200 deg. R. Ability to after cool the compressed charge could therefore be another side benefit of the novel three cycle invention disclosed.

Many alternative cylinder layouts are possible in both cam driven and crank driven versions including "opposed flat" layouts, V-layouts, in-line layouts, X-layouts. Similarly, many alternative combustion chamber volume adjusting means are possible, including Saginaw ball bearing nut means; similarly, many alternative charge pre-compression compressor means are possible. Similarly, many alternative valve means may be employed.

Accordingly, while the invention has been disclosed by reference to many specific preferred embodiments, it should be understood that numerous changes could be made within the scope of the inventive concepts disclosed. Accordingly, the invention is not intended to be limited by the disclosure, but rather to have the full scope permitted by the language of the following claims.

The embodiments of the invention in which an exclusive property or privilege is claimed are defined as follows:

1. A three cycle, internal combustion engine, comprising in combination a cylinder block having a number of cylinders, a piston reciprocal in each of said cylinders, a radial profiled power cam shaft provided with journals for rotatable support in said cylinder block, a piston connecting means defining a means operatively connecting each said piston to said power shaft to convert its reciprocating motion to rotational motion of said power shaft, a cylinder head means, disposed on top of said cylinder block and closing each of said cylinders to form a combustion chamber therein, said cylinder head means including charge admission port means and exhaust port means communicating with each said cylinder, and charge admission valve means to control opening and closing of said charge admission port means and exhaust valve means to control opening and closing of said exhaust port means, valve actuation means between said power shaft and said valve means for actuating said valve means in relation with a position of said piston, with said charge admission port means open momentarily while the piston position is in a top portion of said cylinder, and with said exhaust port means open during a greater portion of an upward stroke of said piston in said cylinder, a charge pre-compressor, defining a positive displacement compressor means to compress an air charge to a pre-combustion pressure, said charge pre-compressor being operatively connected to said power shaft, and including means for introducing a combustible fuel into the air charge, a charge transmission duct defining communicating ducting between said charge pre-compressor and said charge admission port means, a combustion chamber volume adjusting means, defining a means to vary the volume of said combustion chamber within limits, said positive displacement compressor cooperating with said charge transmission duct to provide a sufficient compressed charge of air whereby the mass of the charge admitted into said combustion chamber essentially varies in accordance with the volume of the combustion chamber, thereby allowing control of the engine output by controlling said combustion chamber volume adjusting means, an ignition means, igniting the charge in said combustion chamber immediately after said charge admission port means has closed, and wherein operation of said combustion chamber comprises three distinct cycles, a high pressure charging cycle, with the piston in the top portion of said cylinder immediately followed by an expansion cycle, carrying said piston to a bottom position in said cylinder, immediately followed by a positive exhaust expulsion cycle carrying said piston back to the top portion of its stroke in said cylinder and wherein said cylinder head means includes a static cylinder head and a telescoping head associated with each of said cylinders, each static cylinder head being disposed on a top end of one of said cylinders, and provided with a bore, coaxial with and communicating with said one cylinder, each static cylinder head containing said exhaust port means and said charge admission port means;

each telescoping head, being reciprocal within limits, within said bore of said associated static cylinder head, each telescoping head including said charge admission valve means and said exhaust valve means, said combustion chamber volume adjusting means including a screw threaded means engageable with each of said telescoping head for controlling position of each said telescoping head within said static cylinder head relative to a top position of said piston.

2. An engine according to claim 1 wherein said exhaust port means of said static cylinder head associated with each of said cylinders includes an annular exhaust port, defining an annular slotted opening directly above a top edge of said cylinder, said port being of full circumferential extent, and coaxial with and communicating with said cylinder, an annular valve guide slot, defining a cylindrical space, directly above the top edge of said cylinder, said cylindrical space having an outside diameter slightly larger than the bore of said cylinder and inside diameter smaller than said cylinder, said space communicating downwardly with said annular exhaust port and said cylinder over the full annular extent, said space being coaxial with said cylinder, an internally threaded jackscrew bore, defining a bore coaxial with said cylinder and said annular valve guide slot, said bore communicating downwardly with said cylinder and communicating upwardly with a cylinder head cover space said jackscrew bore threadably engaging said screw threaded means, and an exhaust torus defining at least a partial donut shaped exhaust collector duct, coaxial with said annular exhaust port, and communicating with said port inwardly;

an intake torus, defining a full or partial donut-shaped intake duct, coaxial with said cylinder and communicating with said cylinder via intake ducts associated with said charge admission port means, annularly arranged around said internally threaded jackscrew bore, and wherein said exhaust valve means defines an exhaust sleeve valve, reciprocatably disposed in said annular valve guide slot, and closing communication between said cylinder and said annular exhaust port, said exhaust sleeve valve comprising a thin walled cylindrical sleeve, spring biased downwardly, and further including a face determining the distance between a bottom of said telescoping head and the top position of said piston, and thereby determine the volume of said combustion chamber, said volume being changeable by rotation of said screwthreaded means.

3. An engine according to claim 2 wherein said static cylinder head defines at least part of said cylinder head disposed on top of said cylinder block, and closing the top end of said cylinders, said exhaust port means including an annular exhaust port, defining an annular slotted opening directly above the top edge of said cylinder, said port being of full circumferential extent, and coaxial with and communicating with said cylinder, an annular valve guide slot, defining a cylindrical space, directly above the top edge of said cylinder, said cylindrical space having an outside diameter slightly larger than said cylinder and an inside diameter smaller than said cylinder, said space communicating downwardly with said annular exhaust port and said cylinder over the full annular extent, said space being coaxial with said cylinder, an internally threaded jackscrew bore threadably engaging said screwthreaded means and defining a bore coaxial with said cylinder and said annular valve guide slot, said bore communicating downwardly with said cylinder and communicating upwardly with a cylinder head cover space, an exhaust torus, defining at least a partial donut shaped exhaust collector duct, coaxial with said annular exhaust port, and communicating with said port inwardly, an intake torus defining at least a partial donut shaped intake duct, coaxial with said cylinder and communicating with said cylinder via intake ducts associated with said charge admission port means, annularly arranged around said internally threaded jackscrew bore, and wherein said exhaust valve means defines an exhaust sleeve valve, reciprocatably disposed in said annular valve guide slot, and closing communication between said cylinder and said annular exhaust port, said exhaust sleeve valve comprising a thin walled cylindrical sleeve, spring biased downwardly with an outside diameter which closely matches an outside diameter of said annular valve guide slot, and further including an inward facing ledge formed inside the bottom edge of said sleeve valve, said ledge providing a seat for a mutual valve spring to be subsequently defined, and further including a valve face, defining a full annular contact surface, located on a bottom of said sleeve valve and seatably engaging the top edge of said cylinder to close communication between said cylinder and said annular exhaust port, said exhaust sleeve valve further including an attachment means for upward directed pull rods, said attachment means being disposed on a top edge of said exhaust sleeve valve, an admission sleeve valve, reciprocatably and coaxially disposed in said annular valve guide slot, said admission sleeve valve comprising an upwardly spring biased cylindrical sleeve, with an inward facing flange and including a. a first sleeve, defining a cylindrical sleeve with an outside diameter which matches an inside diameter of said inward facing ledge of said exhaust sleeve valve, said first sleeve being reciprocative within said ledge, b. a valve head, defining an inward facing flange located inside a bottom inside edge of said first sleeve, said valve head having an upward facing conical seat coaxial with said cylinder, c. a second sleeve, defining a cylindrical sleeve with an inside diameter which matches an inside diameter of said annular valve guide slot, said second sleeve being smaller in diameter than said first sleeve and being located above said first sleeve, said second sleeve having an outward facing flange around a bottom outside edge, which connects said second sleeve to a top inside edge of said first sleeve, d. said second sleeve reciprocatably engaging said annular valve guide slot, e. a spring seat, defining an outward facing flange, located around a top portion of said second sleeve, said flange having an outside diameter which matches an inside diameter of said thin-walled cylindrical sleeve of said exhaust sleeve valve, a mutual valve spring, defining a large coil spring, coaxial with said cylinder and disposed within said exhaust sleeve valve to engage said inward facing ledge downwardly and to engage said spring seat of said admission sleeve, said mutual valve spring biasing said exhaust sleeve valve downwardly and biasing said admission sleeve valve upwardly, and wherein said screw threaded means is a jackscrew defining a hollow cylinder, said jackscrew extending downwardly a short distance beyond a bottom edge of said jackscrew bore, and including a jackscrew drive means, and wherein said telescoping head defines a stemmed head, coaxially and reciprocatably, within limits, disposed in said jackscrew and said admission sleeve valve and defining a mushroom-shaped component with a round stem portion and a round coaxial head portion, said head portion facing downward and seatably engaging an upward facing conical seat of said admission sleeve valve, for closing communication between said cylinder and said intake torus, said round stem portion directed upwardly and disposed within the hollow cylinder of said jackscrew, said stem portion protruding upwardly from a top edge of said jackscrew to terminate in an externally threaded top portion, said telescoping head further including a coaxially located ignition means, mounted inside said head portion and reaching the combustion chamber in said cylinder, said telescoping head further including a seat engageable with a bottom end face of said jackscrew, with the engagement between said seat and said bottom end face determining the distance between a bottom of said telescoping head and the top position of said piston, and thereby determine the volume of the combustion chamber, said volume being changeable by rotation of said jackscrew, and including a stopper disc, defining a disc with an internally threaded coaxial hole, said disc being mounted coaxially on said externally threaded top portion of said stem portion, said stopper disc extending beyond the outside diameter of a worm gear of said drive means and engageable with a machined surface on a top of said cylinder head to adjustably limit downward travel of said telescoping head by virtue of the threaded engagement between said stopper disc and said threaded top portion.

* * * * *